US005915388A

United States Patent [19]

Bowen et al.

[11] Patent Number: 5,915,388

[45] Date of Patent: Jun. 29, 1999

[54] DEVICE FOR CONTROLLING FREE-BURN RATE OF AND REDUCING SIDESTREAM SMOKE FROM A CIGARETTE AND THE LIKE

[75] Inventors: Larry Bowen, Orangeville; Stanislav M. Snaidr, Mississauga, both of Canada

[73] Assignee: Rothmans, Benson & Hedges Inc., Ontario, Canada

[21] Appl. No.: 08/860,592

[22] PCT Filed: Jan. 19, 1996

[86] PCT No.: PCT/CA96/00041

§ 371 Date: Sep. 3, 1997

§ 102(e) Date: Sep. 3, 1997

[87] PCT Pub. No.: WO96/22031

PCT Pub. Date: Jul. 25, 1996

[30] Foreign Application Priority Data

Jan. 20, 1995 [CA] Canada ..... 9501146

[51] Int. Cl.[6] ..... A24D 3/04

[52] U.S. Cl. ..... 131/336; 131/331

[58] Field of Search ..... 131/336, 331, 131/349, 235, 240, 175

[56] References Cited

U.S. PATENT DOCUMENTS

| | | | |
|---|---|---|---|
| 4,572,217 | 2/1986 | Newman, Sr. et al. | 131/175 |
| 4,638,819 | 1/1987 | Ikeda | 131/331 |
| 4,726,513 | 2/1988 | Wolfe | 232/43.1 |
| 4,773,435 | 9/1988 | Ikeda et al. | 131/331 |
| 4,920,988 | 5/1990 | Cancellara | 131/242 |
| 5,085,230 | 2/1992 | Roman | 131/235.1 |

FOREIGN PATENT DOCUMENTS

| | | |
|---|---|---|
| 928089 | 2/1959 | United Kingdom . |
| 1183438 | 7/1968 | United Kingdom . |

*Primary Examiner*—John G. Weiss
*Assistant Examiner*—Charles W. Anderson
*Attorney, Agent, or Firm*—Banner & Witcoff, Ltd.

[57] ABSTRACT

A device and process for using same is described for controlling free burn rate of a lit cigarette. The device is mountable on a cigarette and is adapted to permit insertion and movement of the cigarette into the device. The device includes a unit which controls rate of air diffusion to reduce supply of oxygen for supporting tobacco combustion by the lit cigarette coal. The structure for controlling rate of air diffusion is non-combustible at combustion temperature of a lit cigarette coal. By use of this device, the number of puffs per cigarette is greatly increased and, depending upon the selected design of the device for controlling free burn rate can reduce sidestream smoke emitted by a lit idle cigarette.

53 Claims, 15 Drawing Sheets

FIG.18.
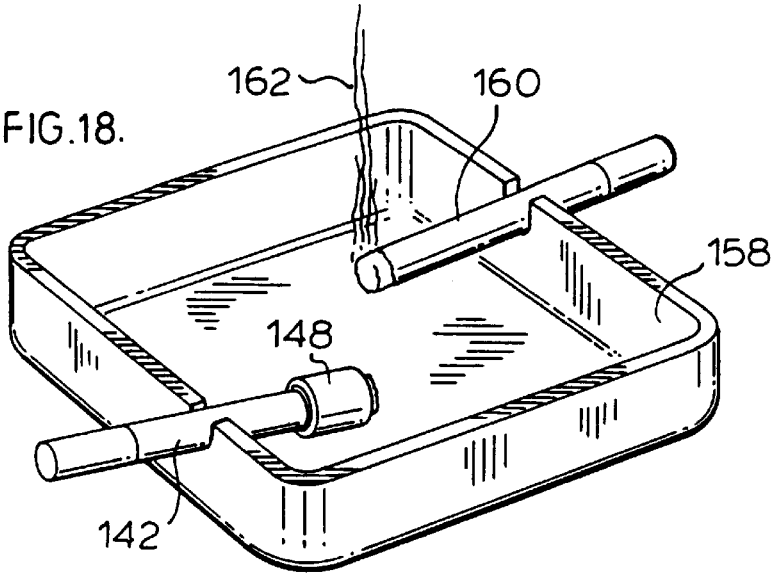
FIG.19.
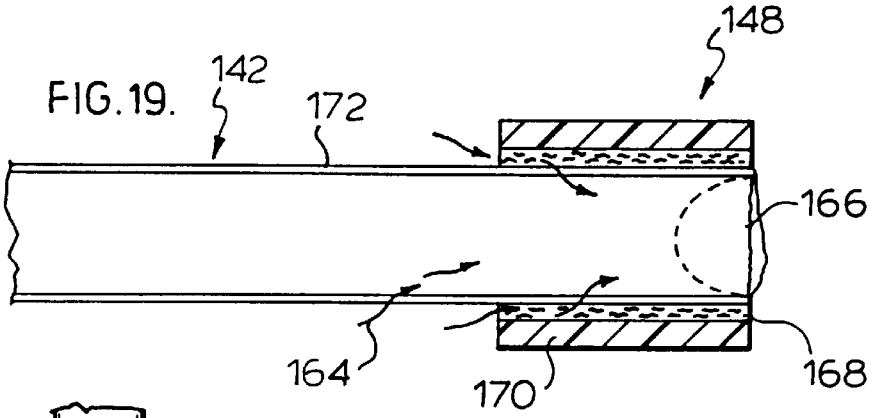
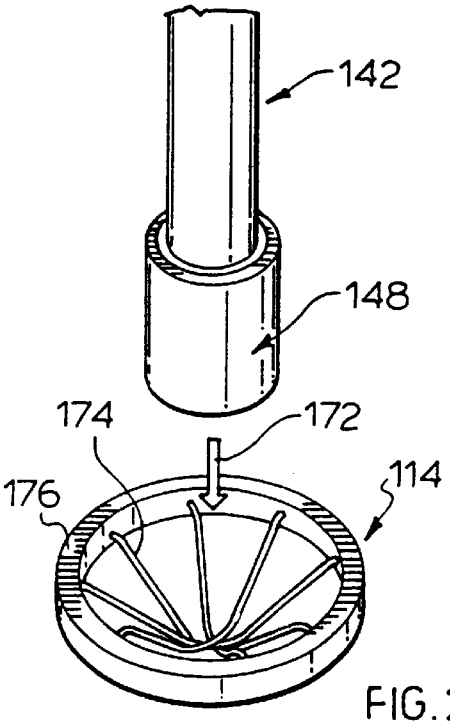
FIG.20.
FIG.21.
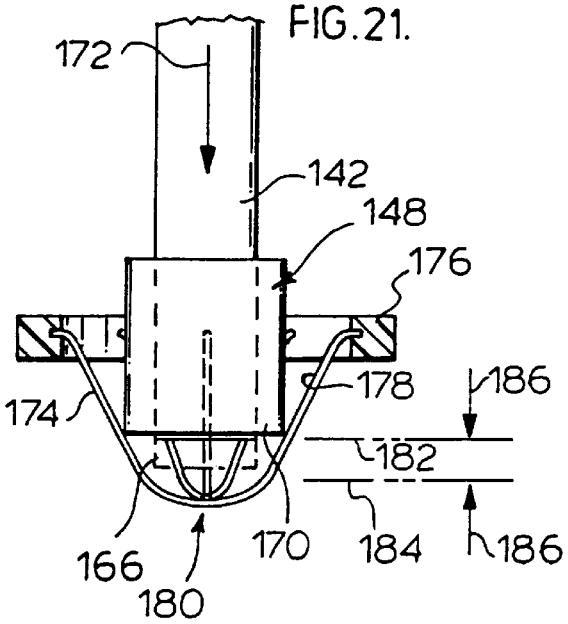

DEVICE FOR CONTROLLING FREE-BURN RATE OF AND REDUCING SIDESTREAM SMOKE FROM A CIGARETTE AND THE LIKE

FIELD OF THE INVENTION

This invention relates to a device which may be mounted on a cigarette and the like to control free burn rate of a lit cigarette.

BACKGROUND OF THE INVENTION

Free burn rate in reference to cigarettes and the like relates to the rate at which the coal or burning ember of a lit cigarette advances along the cigarette when the cigarette is not being smoked. Considerable thought has been given to free burn rate of a cigarette from the standpoint of reducing sidestream smoke generated during the idle phase of the lit cigarette. Various cigarette tobacco and cigarette paper designs have been suggested which, in one way or another, affect free burn rate with a view to reducing sidestream smoke and/or achieving an extinguishment of the lit cigarette when left idle over an extended period of time. Such designs include a judicious selection of tobacco blends, densities and multiple layers of cigarette tobacco in the tobacco rod. Such selection can appreciably retard the free burn rate of the cigarette and hence increase the number of puffs obtained per unit length of cigarette. Either in combination with tobacco selection and construction, or independently of the tobacco make-up, various cigarette paper compositions can also affect free burn rate of the cigarette. Such paper compositions include the use of chemicals to retard free burn rate, multiple wrappings of different types of cigarette paper of the same or different characteristics and reduction of cigarette paper air permeability. In addition to the use of chemicals to extinguish a cigarette when not being smoked, there are a variety of cigarette extinguishing devices. A cigarette ashtray may have a well dimensioned to receive the lit end of the cigarette, such that when the lit end of the cigarette is positioned in the well, the supply of oxygen to the burning coal is substantially reduced such that the cigarette extinguishes very quickly. Another approach to achieve extinguishment of the cigarette is to provide on the cigarette a ring of combustible or meltable material which releases into the tobacco upon melting at the temperature of the burning coal a suitable chemical for immediately extinguishing the cigarette.

Exemplary patents which describe designs in keeping with the above-noted approach in modifying tobacco and paper make up include published EP application 540,361, published May 5, 1993, published EP application 495,567 published Jul. 22, 1992, Canadian Patent 1,259,008 Canadian Patent 1,223,495 Canadian Patent 1,211,021 and Canadian patent 1,300,459.

An approach to reducing the possibility of a burning cigarette starting fires, is to house the cigarette in a screen mesh as described in U.S. Pat. No. 4,194,516. The screen mesh houses the burning portion of the cigarette to thereby contain any sparks and the like which may come off of the cigarette during the smoking process. Although this device may reduce the chances of starting a fire with a lit cigarette, it does not affect the free burn rate of the cigarette, because the screen is of an open mesh design.

French patent 2,556,184 describes a device which may be mounted on a cigarette to extinguish the cigarette at a predetermined location along its length. The device is designed to automatically and completely extinguish the cigarette when the advancing burning coal in the cigarette approaches the device. The device is in the form of a ring which is capable of being moved to any location along the cigarette. The ring is made of a material which melts to release an extinguishing agent which immediately extinguishes the burning end of the cigarette by penetrating the tobacco through to the burning coal. The extinguishing agent may include a perfume so as to avoid a disagreeable odor at the moment when the cigarette is extinguished. Although this device is effective for extinguishing a cigarette, it is not reusable and in being consumed and releasing a perfume into the cigarette, it does not permit re-smoking of the extinguished cigarette.

Another type of extinguishing ring is described in respect of the ash-retaining screen for a cigarette of U.S. Pat. No. 1,211,071. A cigarette or the like is contained in a cage which consists of a screen to effectively confine the ashes and at the same time admit an abundance of fresh air to support combustion. Provided on the exterior of the screen cage is a flame extinguishing collar which is slidable upon the ash-retaining cage and is adapted to be seated at any desired point along the length of the cage for the purposes of extinguishing the cigarette when partially consumed. This device contemplates relighting the cigarette for further consumption. However, neither the device of this U.S. Patent or that of French Patent 2,556,184 contemplates a device which may be used on a cigarette to reduce sidestream smoke from a free-standing lit cigarette.

U.S. Pat. No. 4,638,819 describes a device for decreasing sidestream smoke generated by a lit cigarette. The device has a hole through which the cigarette is inserted. The device permits continuous combustion of the cigarette but limits the quantity of oxygen supplied to the burning ember thereby preventing generation of sidestream smoke when the lit cigarette is sitting idle. The device is moved along the cigarette as the burning ember advances. Several problems are however associated with this type of device. One of the major problems is staining of the cigarette, which results in an unsightly cigarette as the device is moved therealong. Varying diameters in cigarettes do not provide for precise control in the flow of air to the burning ember and hence the device can have a variable effect in decreasing sidestream smoke.

U.S. Pat. No. 5,055,230 describes a smoker's appliance which includes a cigarette receptacle which is capable of reducing quantity of smoke emitted from a lit cigarette while the cigarette is idle. The device includes a hole into which the lit cigarette may be inserted. The hole is polygonal is cross-section. The purpose of the receptacle is to conduct heat away from the burning ember and as well minimize air circulation which could upset the slow burning of the cigarette when in its dormant state. The receptacle does not extinguish the cigarette immediately, but will allow the cigarette to continue to burn at a very slow rate without producing smoke for several minutes. Like the device of U.S. Pat. No. 4,638,819, the cigarette receptacle of solid wall construction causes considerable staining and due to variable cigarette diameters, cannot always reliably provide the desired degree of sidestream smoke reduction and extinguishing times.

U.K. patent specification 928,089 describes a combustion control device for cigarettes which has for its purpose to control the rate at which a cigarette burns, thereby extending the length of time the cigarette is smoked. The control tube has a plurality of apparatus or the like which may be adjusted to control the rate at which air reaches the burning end of the cigarette. In the alternative, crimpings may be provided in the control tube to control flow of air to the burning end. However, such crimping suffers from the same problem an that of U.S. Pat. No. 4,638,819 in not reliably providing the desired control of cigarette burn rate. The control tube is lined with metal foil which can lead to unsightly staining of the cigarette during smoking. The user of the control tube has considerable choice in respect of controlling cigarette burn rate by varying the size of aperture opening, hence, further unreliability in controlling free-burn rate of the cigarette without any consequent control of sidestream smoke.

SUMMARY OF THE INVENTION

In accordance with a first aspect of the invention, a device for controlling free burn rate of a lit cigarette and the like, comprises:

i) an inner ring having an interior dimension to surround and contact a portion of a cigarette, the inner ring defining an annulus of porous material which provides tortuous paths of air flow along a length dimension of the inner ring;

ii) the interior dimension permitting the inner ring to be slid along a cigarette as a cigarette is smoked, iii) an outer ring encasing the inner ring to direct air flow along the length dimension of the inner ring;

iv) the tortuous paths of the annulus controlling rate of air diffusion through cigarette paper to reduce supply of oxygen for supporting tobacco combustion by a lit cigarette. coal and controlling thereby free burn rate of a lit cigarette.

In accordance with a second aspect, the invention provides a smoker's kit for use in reducing sidestream smoke released from a burning cigarette and the like by controlling free-burn rate thereof. The kit comprises:

i) a device for reducing sidestream smoke, having a ring dimensioned to surround and contact a portion of the cigarette, the device being retractable along a cigarette as a cigarette is smoked;

ii) a holder for the device, the holder presenting the device to permit insertion of an end of a cigarette into the ring; and iii) means for retracting the device along a lit cigarette when an end of a lit cigarette is engaged with the retracting means.

In accordance with another aspect of the invention, a method of reducing sidestream smoke of a lit cigarette and the like comprises:

i) locating the device of the first aspect of the invention on a cigarette near its burning coal; and ii) retracting the device along the cigarette away from the cigarette coal before a user puffs on the cigarette, the device being retracted a desired extent to allow the burning coal to advance near or within the device as a user puffs on the cigarette.

In accordance with other aspects of the invention, the device may be adapted to be manually or automatically retreated or retracted along the cigarette before taking the next puff on the cigarette. Air diffusion control may be accomplished by fibrous material located on the cigarette either within a ring or in another manner supported to surround the cigarette where the fibrous material controls the rate of air diffusion. The fibrous material may contain activated charcoal and other additives which enhance smoking pleasure and lessen the extent of sidestream smoke.

Various advantages and features of the invention are realized in accordance with various embodiments of the invention. The device can at least double the number of puffs per unit length of the cigarette. When the device is used in conjunction with higher density tobaccos, the number of puffs per cigarette could be increased an extraordinary amount to provide a very long lasting cigarette. Alternatively when the device is used with cigarettes having considerably less tobacco, particularly expanded tobaccos, the number of puffs obtained from such light density cigarettes can be increased to a normal level of puffs. Otherwise, a cigarette of this nature has a free burn rate which is unacceptable for most smokers because the cigarette is burned up before the usual number of puffs can be obtained from the cigarette. Furthermore, the free burn rate control device of this invention may be designed to extinguish the cigarette if it is unattended or left idle for an extended period of time. Also, in the design of the air diffusion control elements, only a sufficient amount of air is allowed to diffuse into the cigarette so that the cigarette does not burn out if the cigarette is left unattended it remains lit for an extended period of time, such as up to three to five minutes. The device, according to this invention in providing for extinguishment of the cigarette, is itself not consumed so that the device may be retreated from the extinguished end of the cigarette, relit and re-smoked. Since the device permits burning of the tobacco around the outside taste layers of the cigarette, the smoked cigarette, whether lit for the first time or relit, provides the desired taste and satisfaction for the smoker.

BRIEF DESCRIPTION OF THE DRAWINGS

Preferred embodiments of the invention are shown in the drawings wherein:

FIG. 18 is a perspective view of two lit cigarettes, one of them having a device mounted thereon to reduce sidestream smoke;

FIG. 19 is a section through the lit cigarette with the device mounted thereon;

FIG. 20 shows a defined recess into which the lit cigarette with the device may be inserted;

FIG. 21 shows the retraction of the device along the cigarette as it is inserted in the recess;

DETAILED DESCRIPTION OF THE PREFERRED EMBODIMENTS

The device for controlling free burn rate, in accordance with this invention, provides for a control on the rate of air diffusion through the cigarette paper to supply the needed oxygen in controlling combustion temperature of the lit cigarette coal. By controlling the rate of air diffusion, the temperature of the lit cigarette coal can be reduced to a smoldering temperature. The diffusion control device can be designed in accordance with an embodiment of the invention to reduce air diffusion to an extent that the coal temperature drops below smoldering temperature and results in extinguishment of the cigarette in not less than 30 seconds and usually in two to three minutes after the last puff and not more than five minutes. Alternatively, the rate of air diffusion may be only slightly reduced from the normal rate of air diffusion when the device is not on the cigarette, so that the coal temperature slowly reduces and hence provides an extended time between puffs due to this control of free-burn rate. Although the free burn rate of the cigarette is dependent upon the cigarette and tobacco composition and structural aspects thereof, a normal cigarette will have a sufficient free burn rate to maintain the coal at a temperature which continues advance of the coal along the cigarette. The device, in accordance with an aspect of this invention in reducing air diffusion to the coal, will reduce the coal temperature. It is believed that in reducing the coal temperature there is a cyclical event where in reducing coal temperature there is less demand for air, so that less air is pulled through the diffusion controlling element and hence the coal temperature drops further. By way of this cyclical interrelated reduction of coal temperature and demand for air to support combustion, the coal temperature eventually falls to a level where combustion is no longer maintained and the cigarette extinguishes. The device, in accordance with this invention, achieves this control by a variety of alternative designs depending upon one or more of the criteria of timeframe in which it is desired to extinguish the cigarette, comfort for the user, desired degree of in sidestream smoke reduction and characteristics of extinguished cigarette which provides normal smoking characteristics upon relighting.

Figure 1A:
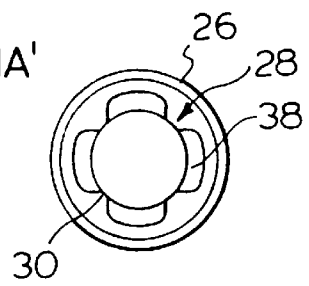
FIG. 1 includes views A, B, C and D showing various aspects of a free burn rate control device of the invention.
Figure 1A:
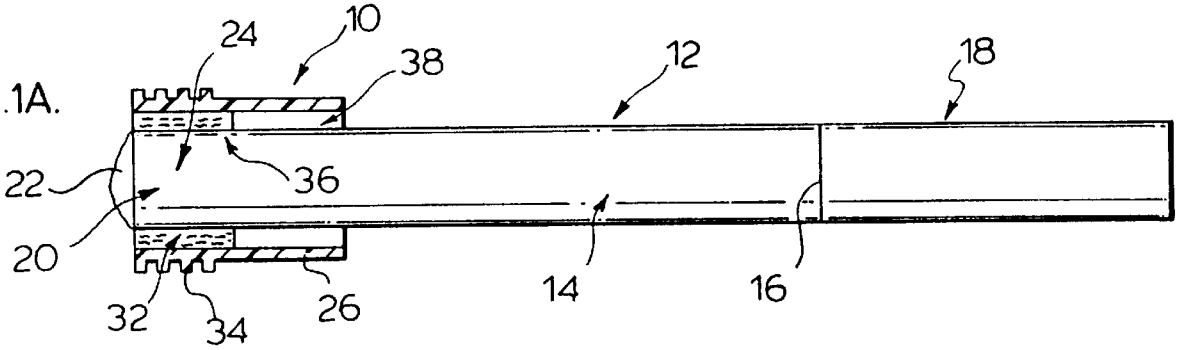

With reference to the drawings, FIG. 1A shows a device 10 mounted on a cigarette 12. For purposes of describing various preferred embodiments of the invention, in conjunction with the drawings, reference will be made to cigarettes. It is understood that the term cigarette includes like items such as cigars and cigarillos. Hence, the term cigarette and the like is intended to include all forms of cylindrical smokeable materials of tobacco.

The illustrated cigarette includes the usual tobacco rod portion 14 encased in a suitable wrapper and affixed to end 16 is a suitable cigarette filter 18. The cigarette is lit at end 20 with the development of the normal ash 22. In a normal smoking event, either during puffing on the cigarette or by virtue of free burn rate, the coal within region 24 of the cigarette end 20 advances towards the filter 18. The device 10 comprises a sleeve 26 or outer ring which surrounds the cigarette portion 14. The sleeve 26 may include a plurality of ribs 28 as shown in the section of FIG. 1A'. The plurality of ribs 28 which, in accordance with this embodiment, comprises four inwardly projecting equidistant ribs 28, mount the device 10 on the cigarette. The inward extent of the rib projection is selected such that the ribs lightly squeeze regions 30 of the cigarette portion 14 to provide for a mounting of the device on a cigarette, but still allowing the device 10 to be slid along the cigarette portion 14 towards the filter 18 as the burning coal 24 advances towards the filter.

The device 10 also includes element or inner ring 32 for controlling the rate of oxygen diffusion through the cigarette paper and towards the coal region 24. In accordance with the particular embodiment illustrated, the air diffusion control device comprises an inner ring of fibrous material for surrounding the cigarette and which is of sufficient density to retard air diffusion towards the coal region 24 to the extent desired in providing for the extended idle time of the cigarette when not being puffed. The density of the fibrous material may range from approximately 25 to 300 $gm/m^2$ for a fibrous sheet thickness of approximately 0.5 mm. The preferred density is in the range of 200 $gm/m^2$. The sleeve 26 includes ribs 34 which extend circumferentially of the sleeve and extend outwardly thereof to provide a degree of comfort when holding the device in one's fingers, because of heat transfer to this region of the device through the air diffusion control element 32.

Although it is difficult to scientifically predict the manner in which air diffuses to the coal region 24, it is believed, as born out by the practical application of the device 10, that the air which carries the necessary oxygen to support combustion of the coal 24, diffuses through the cigarette paper in region 36 and diffuses through the tobacco to support continued combustion of the tobacco by the coal. It is therefore not necessary for the device 10 to extend beyond the ash 22. It is thought that this region of the burning cigarette develops sufficient gas pressure that the gases from combustion exit the cigarette through the ash region 22. If this were not the case, then the device 10 would not operate as effectively as has been demonstrated by its use on various types of cigarettes. Hence the sleeve 26 has provided between the ribs 28 longitudinally extending openings 38 which allow air to travel along the sleeve 26 through the air diffusion control element 32 and then through the cigarette paper. The longitudinal length of the element 32 is selected to control rate of air diffusion in the region 36 which is needed to support continued combustion of tobacco. In accordance with one embodiment of the invention, the element 32 has a length greater than about 5 mm and may extend much further depending upon the selected porosity for the element 32. As is appreciated for a selected porosity for the element 32, the longer its length the greater reduction there is in air diffusing towards the cigarette coal 24 providing the outer ring is air impervious. The porosity of the element 32 may vary greatly depending on the selection of the previously mentioned criteria and types of fibrous material used and their equivalents. The porosity of the material may therefore range from 15 Corseta units to 3000 Corseta units.

As shall become apparent from the following discussion, the use of a ring of fibrous material greatly enhances secondary smoke reduction. In addition, the fibrous ring surprisingly has the advantage of minimizing or eliminating staining of the cigarette which commonly occurs beneath the solid ring structures such as described in FIGS. 1D, 3, 4 and 5. Staining of the cigarette beneath the sidestream smoke reduction device can be a significant drawback in its use. The presence of staining on the cigarette paper when the device is retracted away from the burning coal before the next puff can be very distracting and distasteful to a smoker, hence, dissuading the smoker from continued use of the device. Also, the presence of staining indicates that moisture in the form of condensation and tar are building up in the stained regions. This build-up can greatly affect the taste and flavor of a smoked cigarette particularly if the cigarette is extinguished and re-lit. It is thought that-the build-up of moisture and tar can harden the outer layers of tobacco in the cigarette hence greatly affecting taste and flavor because it is the outer layers of tobacco which contribute most to the taste and flavor of a smoked cigarette. On the other hand, the porous fibrous material reduces or eliminates the staining problem and also contributes greatly to enhanced control of sidestream smoke. These advantages are believed to be due to the fibrous material providing tortuous pathways through which the air must flow in supplying oxygen to the burning coal of the cigarette. Preferably, the fibrous material is surrounded by an air impervious layer to direct airflow along the length direction of the annulus of fibrous material. In this manner the tortuous pathways are extended to further resist air flow and hence control the rate of air flow to the burning cigarette coal. It is apparent that the fibrous material is not the only type of material which may be used to provide the annulus of tortuous pathways. For example, sintered materials may be used in making the air diffusion control ring, such as sintered metal oxides, sintered glass particles and sintered high temperature plastics. Woven fibers may also be used, such as, woven glass fibre, woven ceramic fibers, woven high temperature plastic fibre and woven metal fibre. Matted fibre materials are also quite acceptable, such as, carbon fibre matt, glass fibre matt, high temperature plastic fibre matt, metal fibre materials and ceramic fibre materials. It is understood that these various porous devices may include activated carbon in one form or another. The preferred material for use in the device is an activated carbon fibre material which is manufactured by Futamura Chemical Industries of Nagoya, Japan.

Figure 1B:
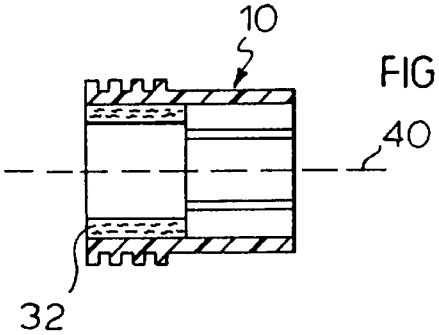
Figure 1B:
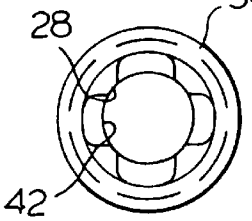

With respect to the embodiment of FIG. 1B, the device 10, in addition to the passageways 38, may also have one or more apertures formed therein to enhance cooling of this portion of the device in the region of the ribs. As shown in FIG. 1B, the ribs 28 as they extend in the direction of the longitudinal axis 40 of the ring, may project inwardly of the inner surface 42 of the element 32 to slightly squeeze the tobacco rod portion 14. However, such squeezing action of the tobacco rod is selected to permit either manual or automatic retreat of the device 10 along the rod portion 14 as the burning coal 24 advances towards the cigarette filter 18.

Figure 1C:
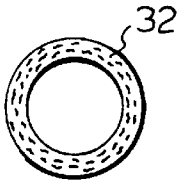

The ring-shaped element 32 is shown in FIG. 1C and has a thickness and length for the fibrous material to provide the desired degree of reduction of air diffusion to the burning coal in controlling the free-burn rate of the cigarette.

Figure 1D:
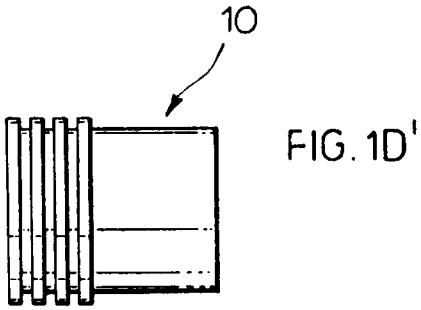
Figure 1D:
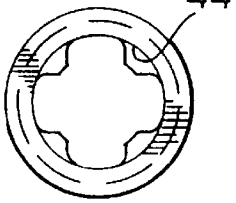

Alternatively as shown in FIG. 1D, the device 10 may be sized such that the interior surface 44, where element 32 is normally placed, is of a diameter approximately the same as the diameter of cigarette portion 14. The interior surface 44 contacts the periphery of the cigarette and, by presenting a solid surface in the region 36, functions as the air diffusion control element to considerably reduce the rate of air diffusion to cigarette coal 24. This structure is similar to the device of U.S. Pat. No. 4,638,819 which has poor performance but may be used in the kit of FIG. 10. Depending upon the longitudinal length of surface 44, the time to extinguish a cigarette will also be varied. It is appreciated that for longer longitudinal lengths for solid surface 44, there is a significant reduction in air diffusion and hence provide a shorter extinction time, such as in the lower desired region of about 30 seconds. As previously noted, although such solid surface rings perform in reducing sidestream smoke and extinguishing the cigarette, they leave unsightly stains on the cigarette and are difficult to advance along the cigarette.

FIG. 1 shows two possible embodiments which may be used in providing the two extremes for control of free burn rate of the cigarette. With either embodiment of FIG. 1A or 1D, the device 10 is retreated or retracted away from the coal along the tobacco rod, a sufficient distance before each puff to allow the coal to advance along the rod during the puff without causing the coal to advance through the length of the air diffusion control element 32 or 44. If the burning coal were permitted to advance through the device 10, control of air diffusion would be lost. It is therefore necessary for the smoker to understand that the device is retreated along the cigarette during the smoking action. This may be accomplished manually with or without indexing devices, as will be described with respect to FIGS. 6 and 7 and FIGS. 20 and 21, or could also be retreated automatically by a suitable device mounted on the cigarette which would sense temperature and then retreat the device 10 by a suitable powered linkage mechanism.

Figure 2B:
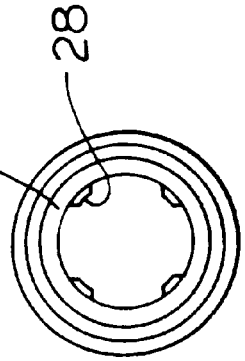
FIG. 2 includes views A, B and C showing an alternative embodiment of FIG. 1A which includes an extension of reduced diameter to facilitate holding of the device.
Figure 2A:
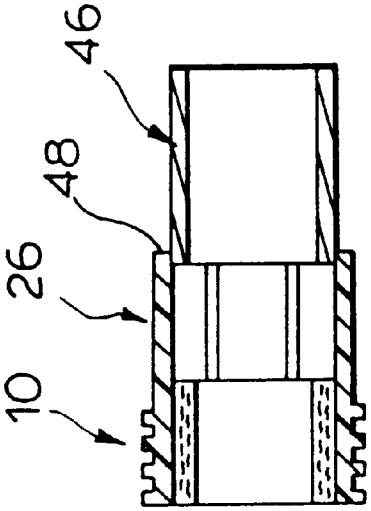
Figure 2C:
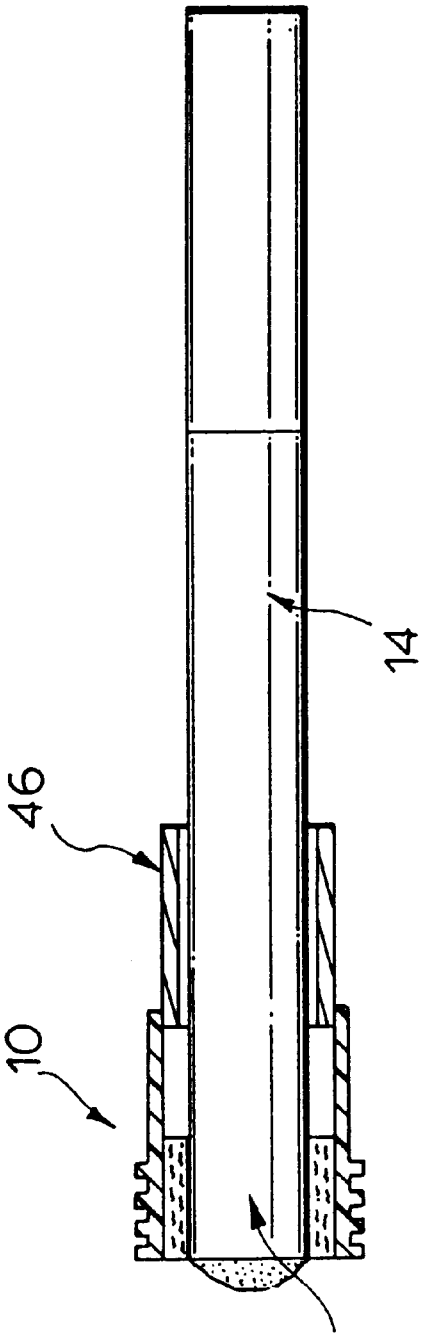

The materials of construction for the device 10 and in particular the air diffusion control element are of materials which are not affected structurally by the heat of the burning coal 24. Suitable materials include high temperature plastics, fire resistant papers, metals, ceramics, and the like. Element 32 or surface 44 is adapted to withstand the high temperatures and not lose the ability to control rate of air diffusion. The chosen materials would also depend upon the design chosen to facilitate manufacture and its use. In this regard, as shown in FIG. 2, a thin sleeve 46 is attached to sleeve 26 at shoulder portion 48. The thin sleeve 46 may be made of ceramic, plastic, or paper and has a diameter as shown in section 2B which is slightly greater than the diameter of the cigarette as indicated by the inner portions of ribs 28. Hence when the device 10 is mounted on a cigarette rod portion 14, the external diameter of the add-on sleeve 46 is very close to the diameter of the cigarette so that the smoker in grasping sleeve portion 46 has a feel similar to smoking a normal cigarette. In addition, the sleeve 46, in being remote from the burning coal in region 24, is affected very little by the temperature thereof so that at best sleeve 46 might feel slightly warm to the touch.

Figure 3A:
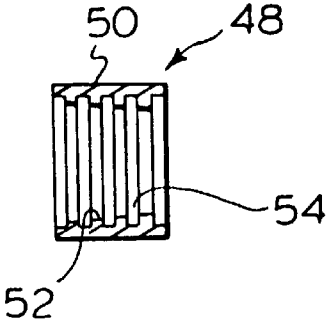
FIG. 3 includes views A, B and C showing an alternative embodiment for the air diffusion control element.
Figure 3B:
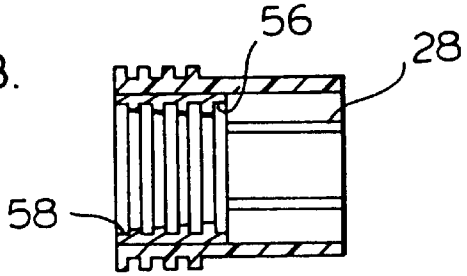
Figure 3C:
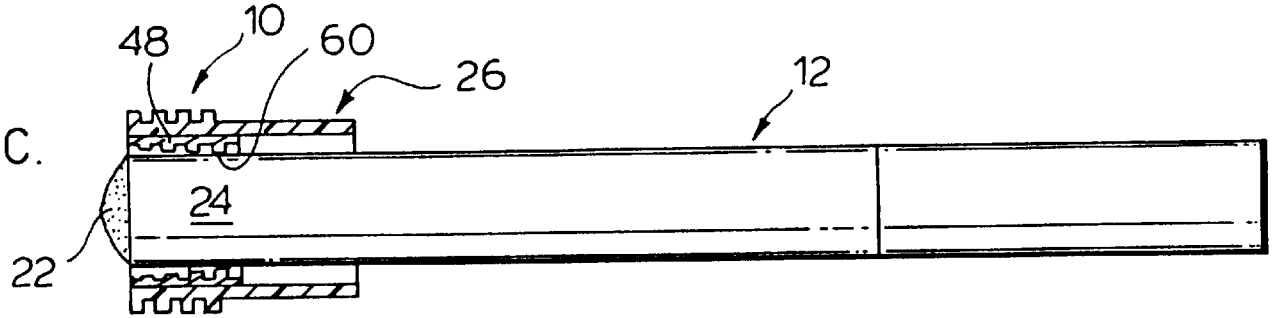

FIG. 3 shows an alternative embodiment for the air diffusion control element. In FIG. 3A, the element 48 comprises a ring 50 having formed on the interior 52 thereof a plurality of spaced apart circumferentially extending grooves 54. The interior surface 52, as shown clearly in FIG. 3B, is tapered in a direction outwardly from the end 56 which is furthest from the burning coal ash 22 towards end 58 which is closest the ash 22. As shown in FIG. 3C, narrow ridge 60, as defined by adjacent grooves 56, is substantially in contact with the periphery of the cigarette 12. This greatly reduces the rate of air diffusion towards the coal region 24. By tapering the surface 52 outwardly towards the ash, the products of combustion are allowed to escape more readily without overheating the sleeve 26 of the device 10. It is understood that rib 60 is positioned sufficiently close to the burning coal 24 to control supply of the desired reduced amount of air to the burning coal.

Figure 4A:
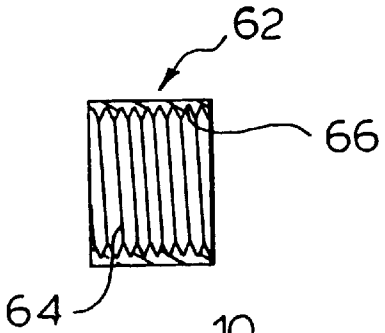
FIG. 4 includes views A, B and C showing an alternative embodiment for the air diffusion control element involving the use of spiral channels.
Figure 4B:
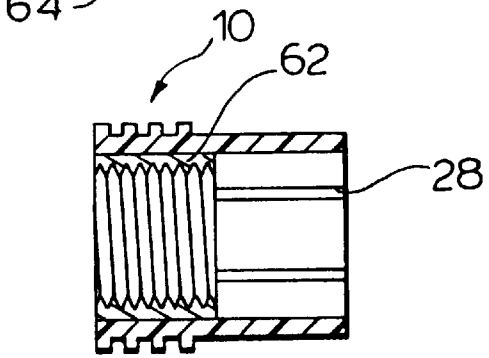
Figure 4C:
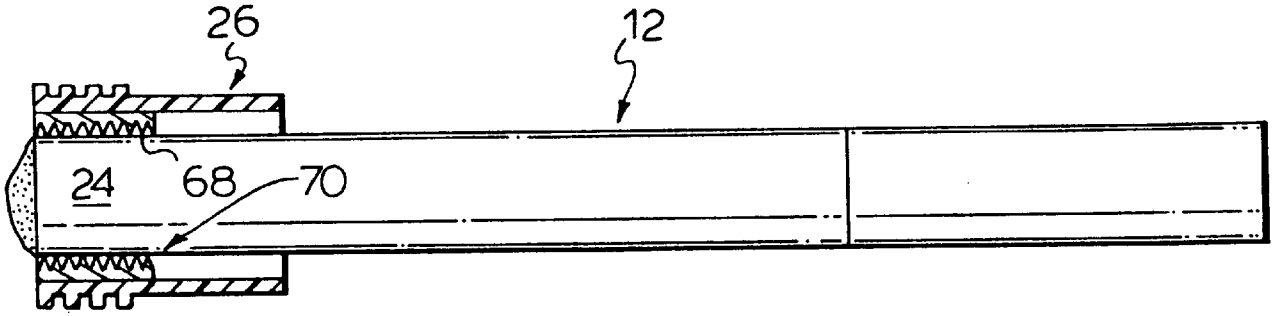

An alternative arrangement for the air diffusion control device is shown in FIG. 4A. The device 62 has formed on its interior surface 64 a continuous spiral groove 66. The element 62 is mounted within the device 10 where the apexes 68 between the spiral grooves 66 contact the cigarette 12 in the manner shown in FIG. 4C. The spiral configuration for the groove controls the rate at which air diffuses to the burning coal 24 by virtue of air entering the open end 70 of the spiral groove and travelling along the spiral groove to enter through the cigarette paper and support combustion of tobacco in the region of the coal 24. The sizing and shape of the spiral grooves are then selected to provide the desired degree of control on the air diffusion rate through the paper towards the coal 24.

Figure 5A:
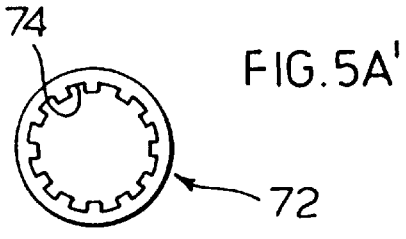
FIG. 5 includes views A, B and C showing an alternative embodiment for the air diffusion control element which has longitudinally extending flutes.
Figure 5A:
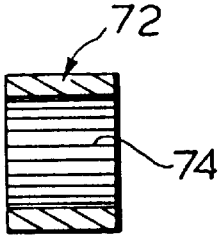
Figure 5B:
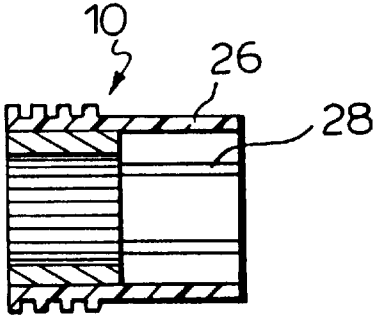
Figure 5C:
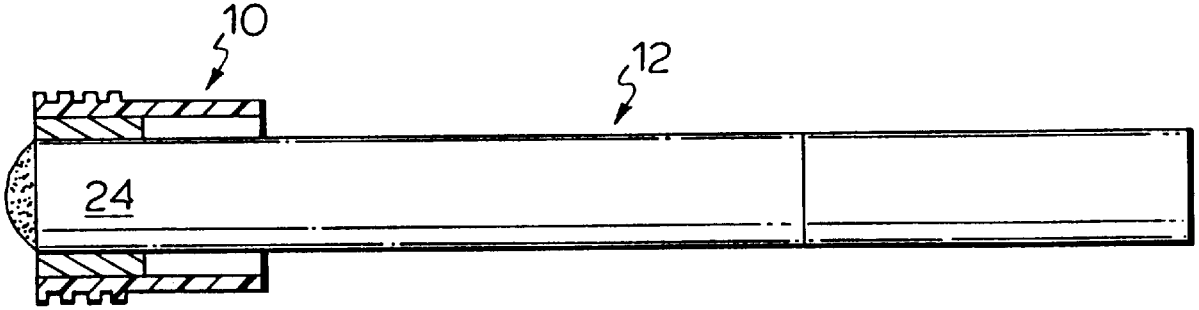

An alternative structure for the air diffusion control element which is similar to the fluted structure of U.S. Pat. No. 4,638,819, is shown in FIG. 5A. The element 72 comprises longitudinally extending flutes 74 as shown in more detail in section 5A'. The element 72 is mounted in a device 10 within the sleeve 26 as with the other elements of the embodiments of FIGS. 1, 2, 3 and 4. As shown in FIG. 5B, the device 10 is then mounted on the cigarette 12 by way of the ribs 28 engaging the cigarette in a slidable manner. The depth and width of the flutes 74 are selected to achieve the desired control on air diffusion towards the burning coal 24. It is appreciated that the larger the depth and width, the greater the rate of air diffusion and hence the greater the free burn rate of the cigarette. Conversely, reduction in dimensions of the flute achieve a considerable reduced free burn rate of the cigarette.

Figure 6B:
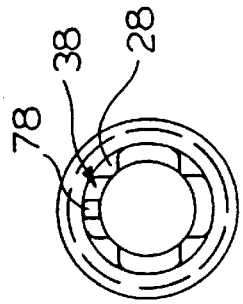
FIG. 6 includes views A, B, C, D and E showing an alternative embodiment for FIG. 1 where the device of FIG. 1A includes indexing means.

In order to assist the user in achieving a stepwise retreat or retraction of the device 10 away from the coal before the next puff, the device 10 can include within the sleeve 26 a pair of indexing blocks 76 and 78 as shown in FIG. 6B. The indexing blocks 76 and 78 are in longitudinal alignment and are positioned within the space 38 between ribs 28. As shown in FIG. 6C, the device 10 is mounted on the cigarette with an air diffusion control device, such as element 32, where the indexing blocks 76 and 78 engage the surface of a tobacco portion 14 of the cigarette 12. The cigarette is lit with ash 22 forming beyond the device 10 and the coal portion being located in the region of the air diffusion control element 32. Before the next puff on the cigarette 12, it is moved relative to the device 10 so as to retreat along the device away from coal 24 towards the filter portion 18. This is accomplished by a relative movement between the cigarette and the device 10 as indicated by arrow 26. In so moving the cigarette, the indexing blocks 76 and 78 commence to rotate. The indexing blocks 76 and 78 may be connected to a device which sounds a click when the blocks have rotated 180° to the position shown in FIG. 6E. The device 10 has now been retreated the desired predetermined distance as indicated by the exposed portion 80 of the cigarette. The extend of retreat of device 10 away from a coal to expose portion 80 is sufficient to allow the user to take the next puff on the cigarette without drawing the coal portion 24 back beyond the air diffusion control element 32. In accordance with the sequence of events shown in FIGS. 6C, D and E, the user retreats the device 10 along the cigarette before each puff. After each puff, the coal is brought within the region of the air diffusion control element 32, so that the free burn rate is now considerably reduced, thereby increasing the number of puffs obtained per unit of cigarette and reducing the sidestream smoke.

Figure 6A:
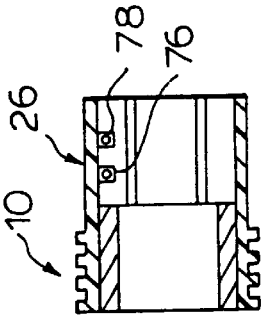
Figures 6C, 6D, 6E:
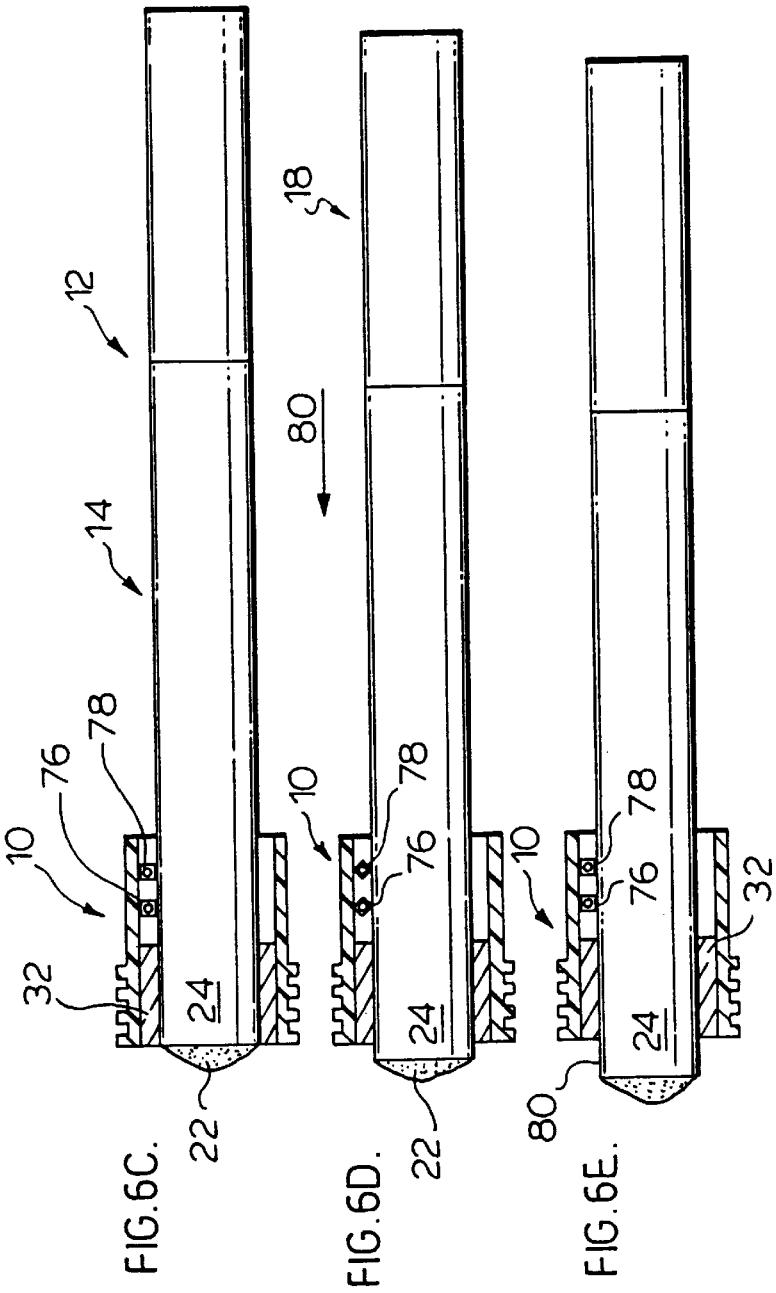
Figures 7A, 7B, 7C, 7D:
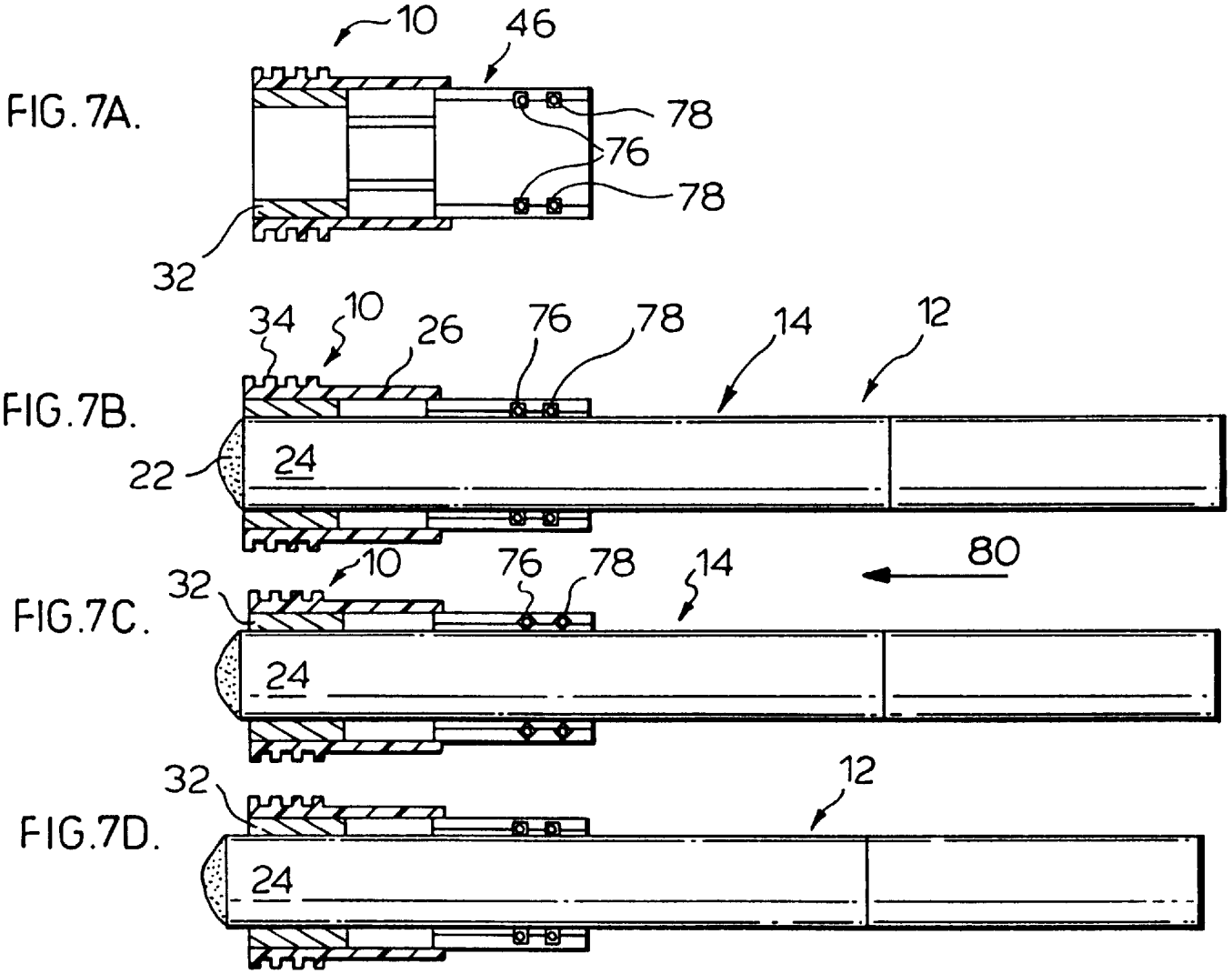
FIG. 7 includes views A, B, C, and D showing an alternative embodiment of FIG. 5 for the indexing means.

An alternative arrangement for the device of FIG. 6 is shown in FIG. 7. In FIG. 7A, the thin sleeve portion 46 of FIG. 2 has a pair of opposing rotating blocks 76 and 78 mounted within the sleeve 46. As shown in FIG. 7B, the opposing set of blocks 76 and 78 engage the periphery of cigarette portion 14 of cigarette 12. The opposing blocks 76 and 78 travel along the cigarette portion 14 as the device 10 is retreated away from the coal 24 to the position shown in FIG. 7D. The blocks have now rotated 180° and sounded a click to indicate to the user that the device is in position to permit the taking of the next puff from the cigarette 12. As with the embodiment of FIG. 6, the cigarette is moved in the direction of arrow 80 so that the air diffusion control element 32 is positioned upstream slightly of the coal 24.

Figure 8A:
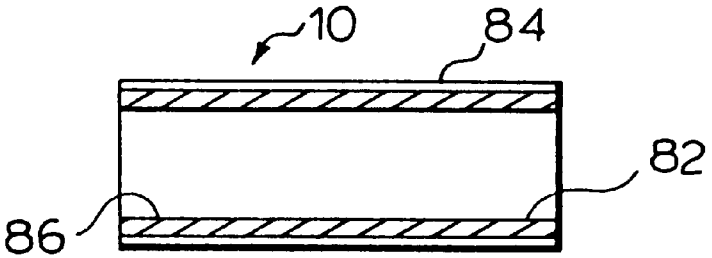
FIG. 8 includes views A, B and C showing an alternative embodiment of FIG. 1C for direct use on a cigarette.

In keeping with the embodiment described with respect to FIG. 1C, the air diffusion control element 32 of fibrous material may be extended considerably in the longitudinal direction to provide an extended element 82 as shown in FIG. 8A. The element 82 may be provided with a protective thin coating 84 of paper, plastics, metal, ceramic or the like. The coating 84 is preferably impervious to air to direct thereby airflow along the fibrous material through its tortuous pathways in the length direction.

Figure 8B:
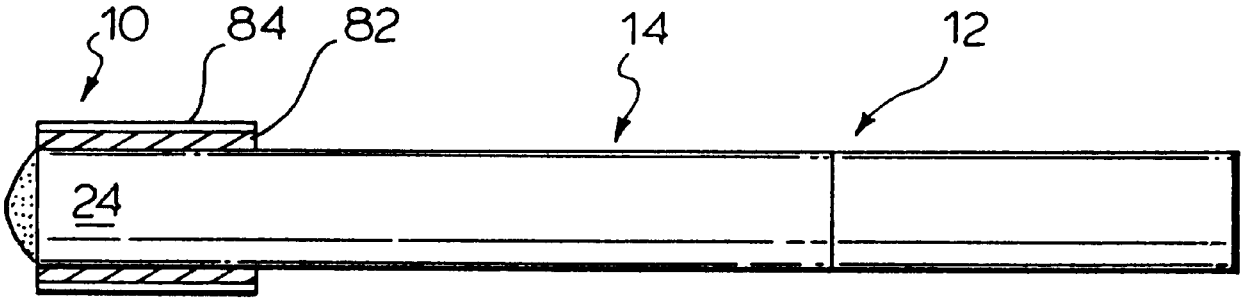
Figure 8C:
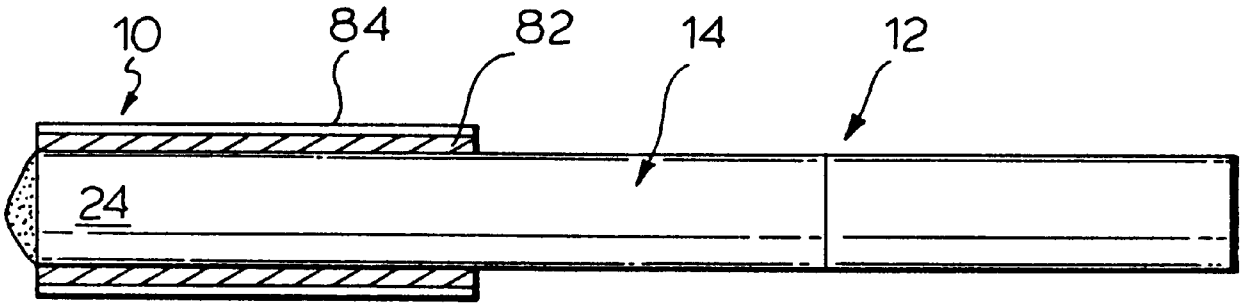

The porosity of element 82 is designed to permit sufficient diffusion of air along the length of the element to supply the necessary but reduced amount of oxygen to support a reduced level of combustion around the coal of the lit cigarette. As shown in FIG. 8B, the element 82 may be of a length approximating one third the length of the tobacco rod portion 14 of the cigarette 12. Alternatively, as shown in FIG. 8C, element 82 may be approximately one half the length of the tobacco rod portion 14 of the cigarette 12. The interior surface 86 of the element 82 provides the means for mounting the device 10 on the cigarette. The diameter of the interior surface 36 is essentially the same as the outer diameter of the tobacco portion 14. The device 10 may be mounted on the cigarette by the manufacturer. The user then retreats the device 10 away from the advancing coal portion for either embodiment of FIG. 8B or 8C in the same manner as described with respect to FIGS. 6 and 7, thereby controlling the free burn rate to provide a significant increase in number of puffs per length of cigarette.

Figure 9B:
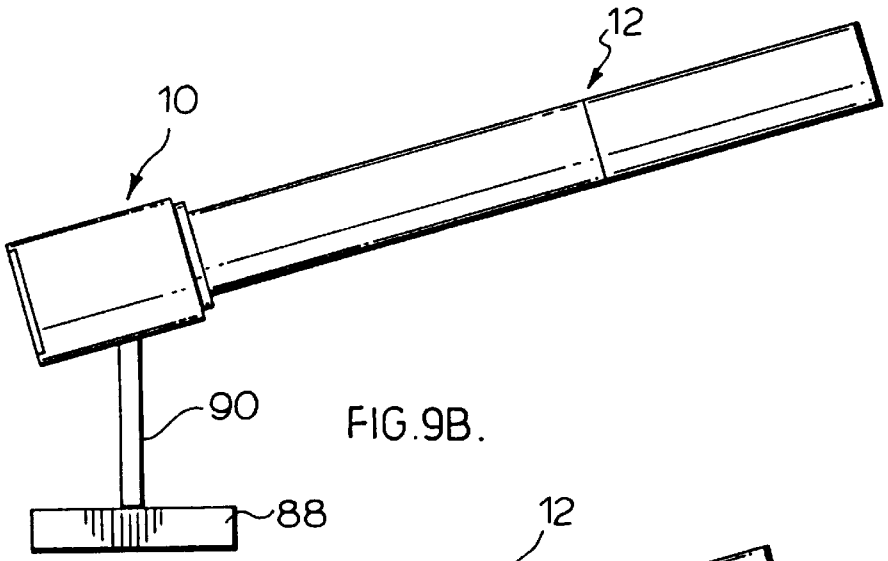
FIG. 9 includes views A, B, and C showing a stand in which a lit cigarette may be parked to provide for a retarded free burn rate while the cigarette is standing idle.
Figure 9C:
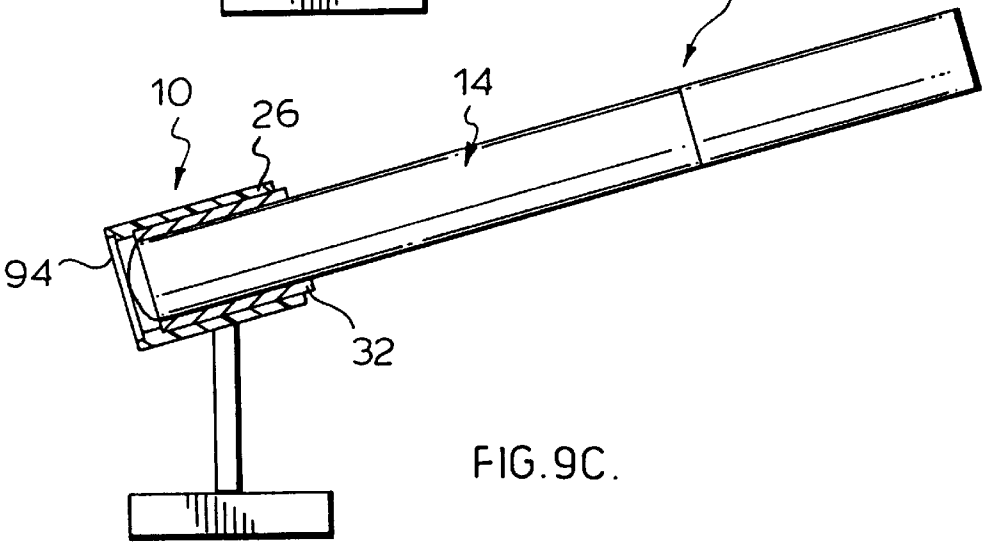
Figure 9A:
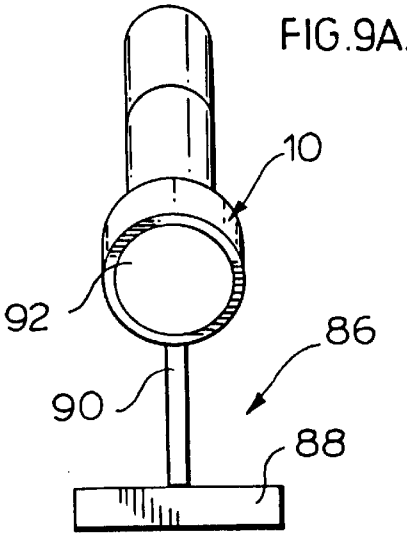

It is understood that the advantages of the free-burn rate control device of this invention may be incorporated in an ashtray or other device in which the cigarette may be parked; that is positioned when not being smoked. As shown in FIG. 9A and B, a stand 86 comprises a base 88 with the standard 90 to which device 10 is attached at an angle as shown in FIG. 9B. The device 10 has a screen 92 mounted in the open end of the device 10 to contain ashes and allow vapors of combustion to escape. As shown in the section of FIG. 9C, the device 10 has a sleeve portion 26 with the screen 92 recessed therein. The air diffusion control element 32 is positioned within the sleeve 26 so that when the cigarette 12 has its lit tobacco portion 14 parked within element 32, the free burn rate of the cigarette is controlled in accordance with this invention. By parking the cigarette within the supported device 10, the smoker may then smoke the cigarette 12 in the normal manner and then after having taken a puff on the cigarette, simply reposition the burning end of the cigarette within the device 10. As with the embodiments described, the air diffusion control element 32, particularly if formed of fibrous material, will function to reduce sidestream smoke when the cigarette is unattended; that is, in the idle mode. In addition, the device 10 of FIG. 9 may be designed to extinguish the cigarette in the event that the cigarette is left parked too long in the supported device 10.

Figure 10:
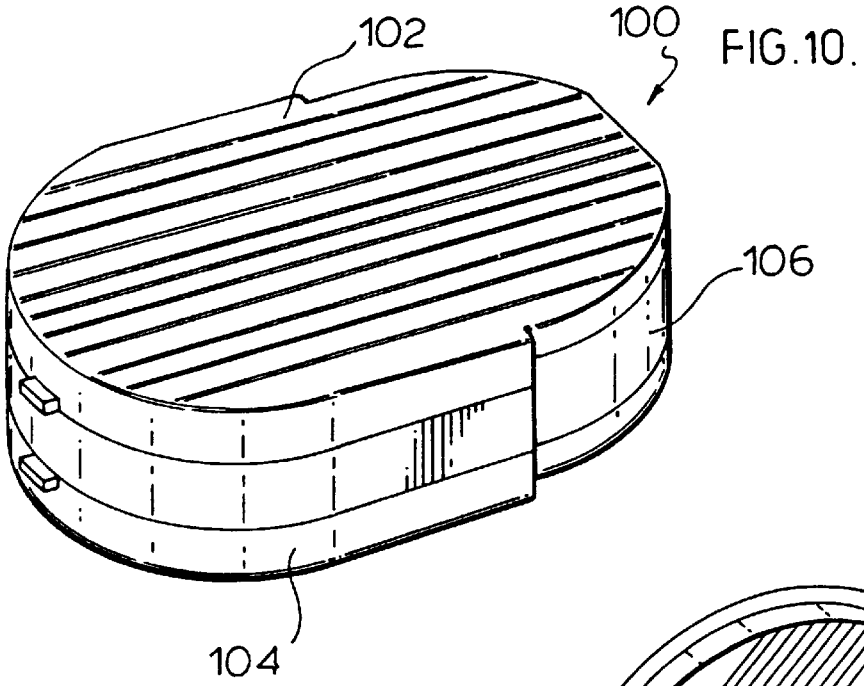
FIG. 10 is a perspective view of the smoker's kit in its closed form.
Figure 11:
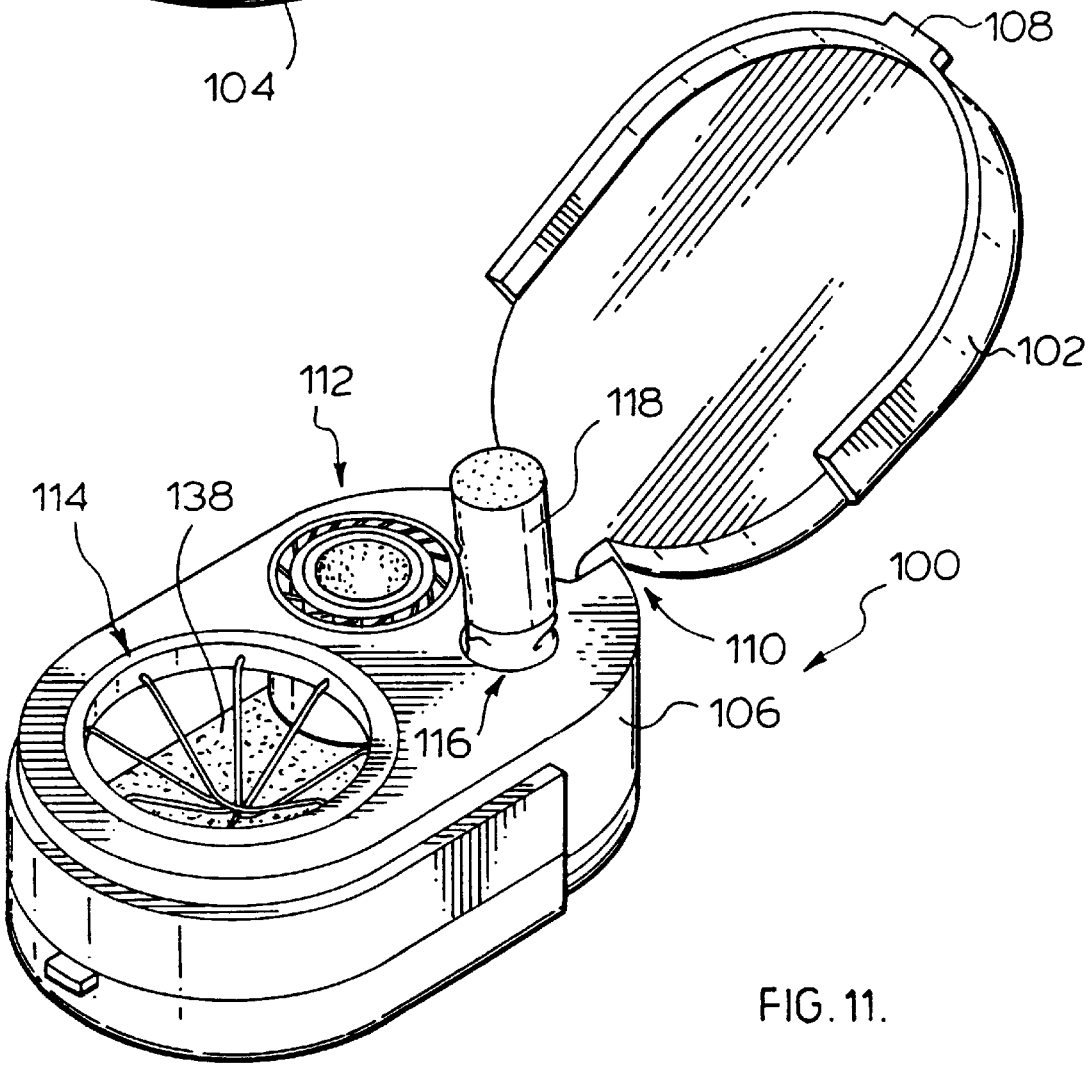
FIG. 11 is a perspective view of the smoker's kit with the lid open and a cigarette extinguished therein.

In order to facilitate use of the devices of FIGS. 1 to 8, a smoker's kit 100 is provided as shown in its closed and open positions in FIGS. 10 and 11. The kit is described in conjunction with the ring device of FIG. 1A, yet with a smooth exterior surface. It is appreciated however that the smoker's kit may be used with any type of ring device, such as those described with respect to FIG. 1D and 2 through 8. The kit is of the standard clam-shell design having an upper lid 102, a releasable bottom 104 and a central body portion 106. The lid 102 may be opened by simply prying the lid upwardly using the finger tab 108. The lid is pivoted at hinge 110. The body portion 106 has a holder 112 for the sidestream smoke control device, a recess 114 for receiving ashes and for retracting the device along a cigarette and a bore 116 which acts as a snuffer and into which a lit cigarette 118 may be inserted to be snuffed.

Figure 12:
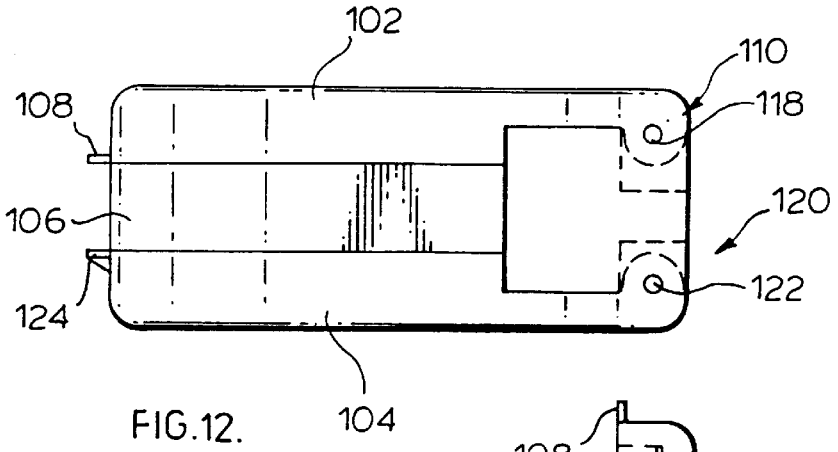
FIG. 12 is a side elevation of the smoker's kit of FIG. 10.
Figure 13:
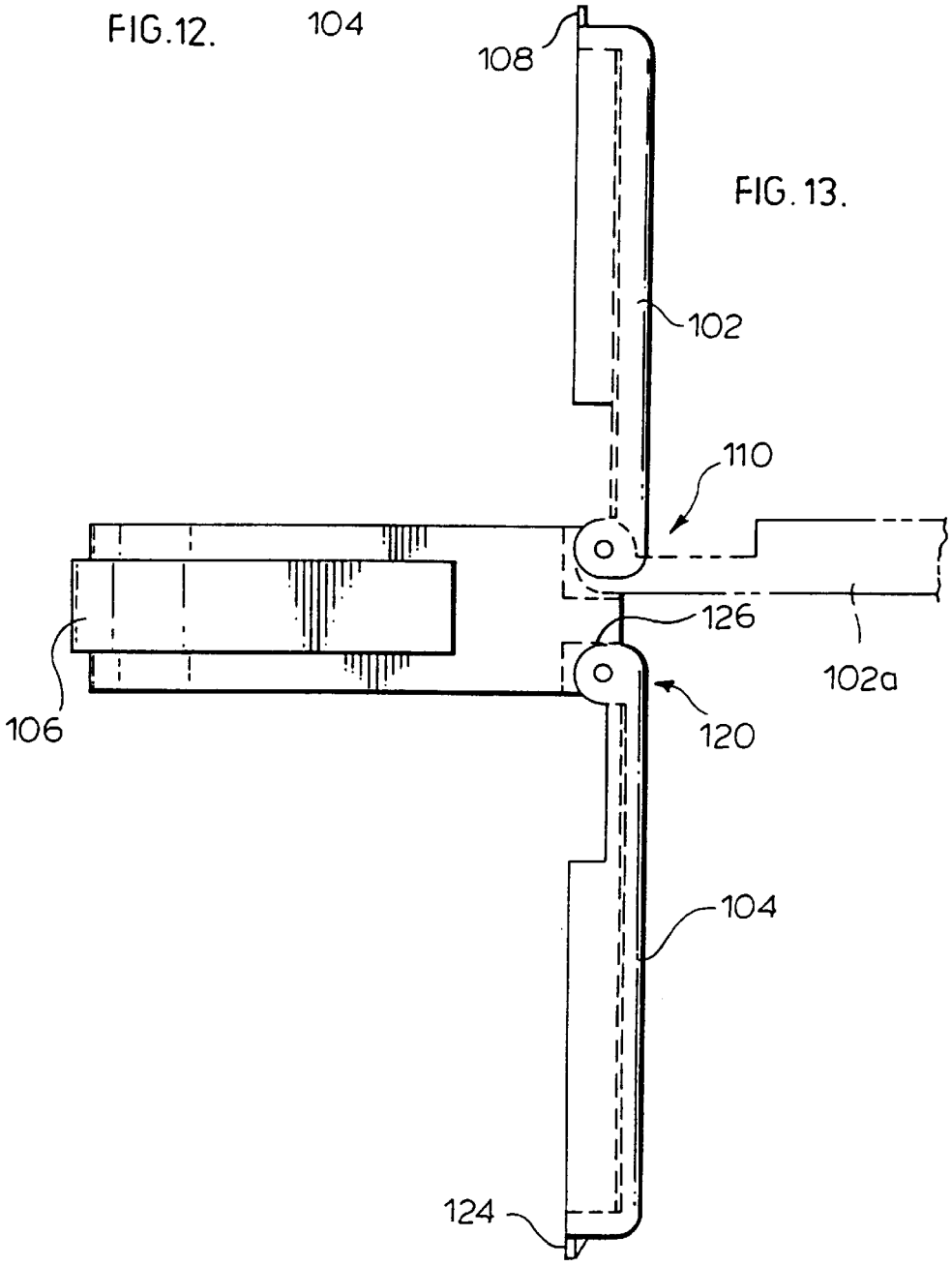
FIG. 13 is the side elevation of FIG. 12 with the top lid and bottom opened.

As shown in FIG. 12, the upper hinge 110 has a pivot point 118. Correspondingly, the bottom 104 has a hinge 120 with pivot point 122. The bottom 104 may have a catch 124 which has to be moved in order to open the bottom. This makes it more difficult to open the bottom but at the same time, reminds the user which is the top and bottom portions of the kit to avoid accidental opening of the bottom with inadvertent dumping of the ashes. As shown in FIG. 13, the lid 102 has a hinge 110 which permits the lid to be swung to the vertical position shown and also 180° to the open horizontal position shown at 102A.

The bottom 104 is also swung open to the 90° open position and preferably as a stop in hinge 120 where the lid 104 abuts the body portion 106 in region 126. The 90° opening for the bottom allows dumping of ashes from the kit and exposes the underside of the bottom 104 to provide for necessary cleaning.

Figure 14:
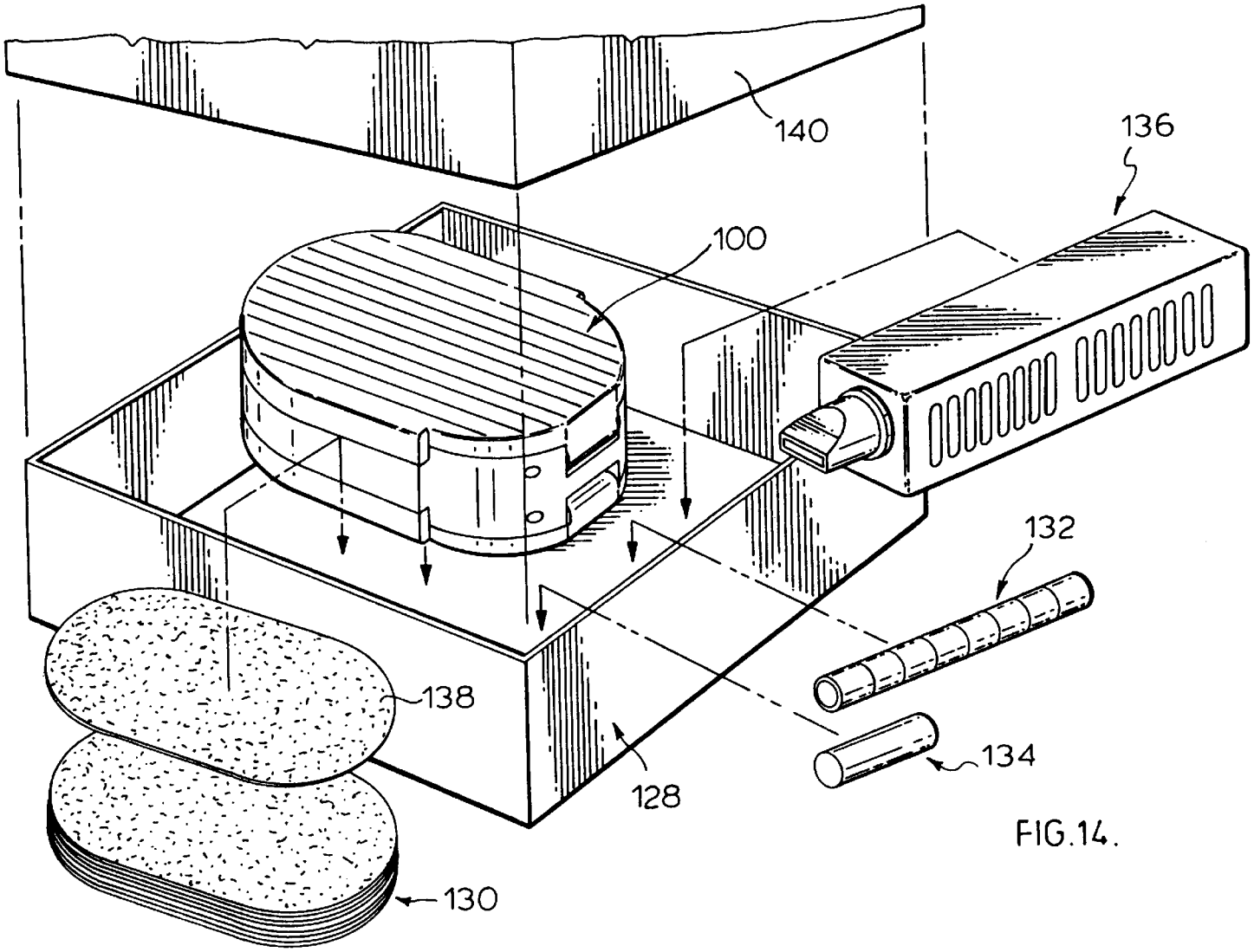
FIG. 14 is an exploded perspective view of various components for a smoker's kit.
Figure 15:
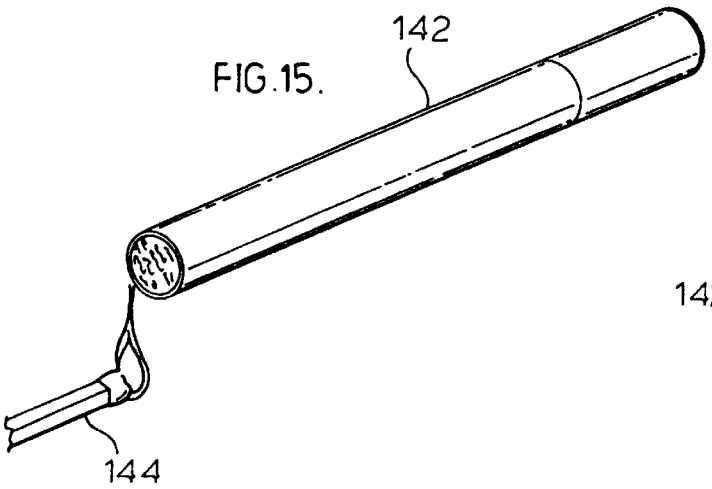
FIG. 15 shows the lit cigarette.

FIG. 14 shows the smoker's kit 100 in a suitable sales package 128. The package includes ancillary items such as a stack of deodorizers 130, a plurality of ring devices 132 for controlling sidestream smoke, a tool 134 for use in cleaning individual rings in the smoker's kit 100 and optionally an exhale filter 136 into which a smoke may be exhaled to further reduce the amount of smoke released during the smoking process.

The individual pads 138 may be placed in the bottom 104 such that when closed the pad is beneath the recess 114. Any ashes or the like falling through the recess 114 land on the deodorizer pad. The deodorizer pad may include activated carbon to adsorb various smells from the cigarette ashes. Also, the pad may include various scents to mask the odors of tobacco smoke which may arise from the kit. As shown in FIG. 11, the pad 138 is in position beneath the recess 114. The pads may include adhesive on their underside so as to lightly stick to the interior of the bottom 104. This ensures that the pad is held in position until the bottom is cleared of ashes or when it is desired to simply dump ashes from the kit but retain the pad in place. Correspondingly, the underside of lid 102 may also include a deodorant pad 138 to further enhance the clearing of cigarette smoke smells from the unit. Everything may be assembled in the package 128 and a lid 140 is provided to contain everything for purposes of sale. The package also provides a convenient storage for unit.

Figure 16:
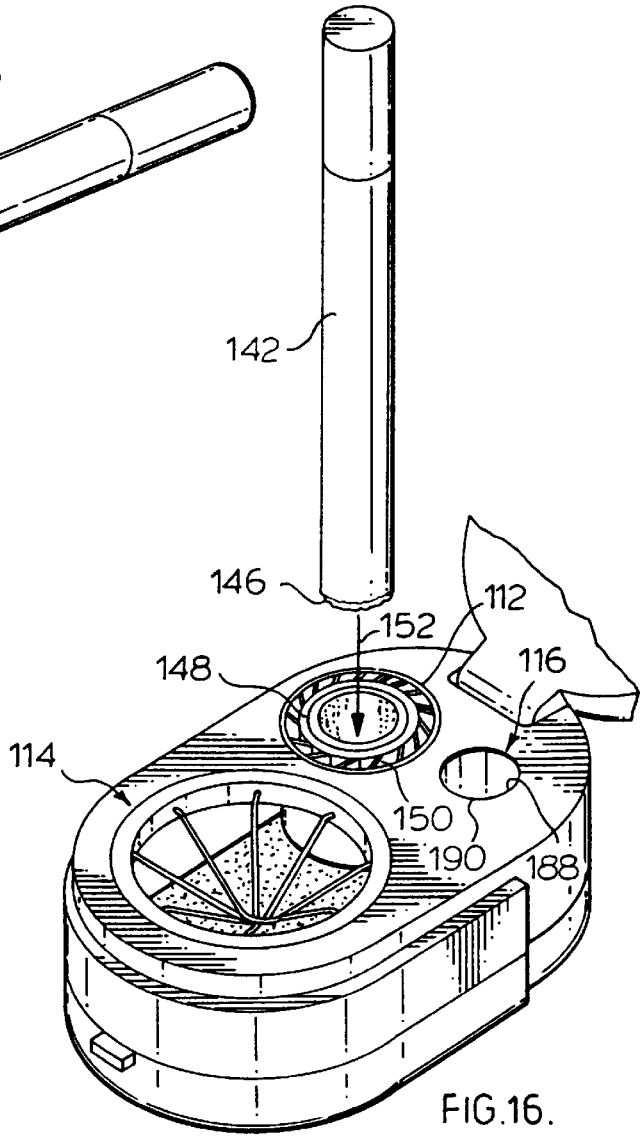
FIG. 16 is a perspective view of the kit with the lit cigarette to be inserted in the device.
Figure 17:
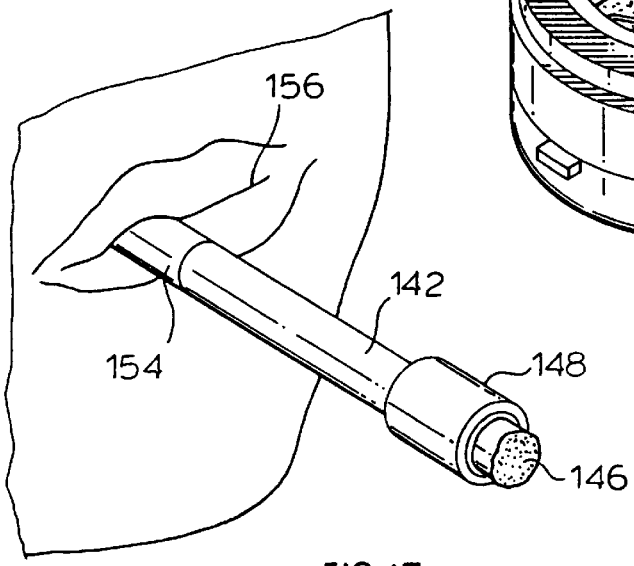
FIG. 17 is a view of a lit cigarette having the device mounted thereon and being smoked.

FIGS. 15 through 21 demonstrate the use of the smoker's kit. A cigarette 142 is lit by use of match or the like 144. The lit end 146 of cigarette 142 is inserted in the ring device 148 which is presented in an upwardly open orientation in the holder 112. The device 148 will be described in more detail with respect to FIG. 19 as will the holder 112 be described in more detail with respect to FIGS. 25 and 26. The holder 112 preferably has a plurality of bristles 150 projecting inwardly to engage the exterior of the ring 48 and to serve a cleaning function, as will be discussed in respect of FIG. 26. The lit cigarette 142 is inserted into the ring 148 in the direction of arrow 152. The interior of the ring is such to receive a cigarette and allow it to be advanced through the ring. With the cigarette pushed all the way into the ring, it can be removed from the holder 112 and in the process pull the ring away from the bristles 150 to provide in combination, cigarette 142 with the sidestream reduction device 148 mounted thereon. The cigarette 142 may be then easily smoked, as shown in FIG. 17, with the usual filter portion 154 in the smoker's mouth 156.

The device 148 is very effective in reducing sidestream smoke coming from a cigarette 142. As shown in FIG. 18, an ashtray 158 has a lit cigarette 160 provided therein. The lit cigarette does not have a device mounted thereon and hence the extent of sidestream smoke emitted from the lit idle cigarette is very noticeable at 162. On the other hand, lit cigarette 142 with the device 148 mounted thereon does not have any visible sidestream smoke above the lit cigarette. As previously described with respect to the devices of FIGS. 1 through 8, the ring-shaped sidestream smoke control device 148, as shown in FIG. 9 substantially reduces and hence controls the amount of air 164 which flows in the direction of the indicated arrows to the burning ember 166. In one embodiment, the device 148 has an inner ring 168 which is preferably of the fibrous material. The inner ring 168 is surrounded preferably by an air impervious outer ring 170. The inner ring 168 has an interior dimension in cross-section which snugly fits the periphery of the cigarette 142. The snug fit is such that the device 148 may be slid easily along the cigarette but preferably sufficiently snug to ensure that air flow which diffuses through the cigarette paper 172 and towards the burning coal 166, is controlled by the inner ring 168. As previously explained, the inner ring 168, in defining tortuous paths for the air to flow before passing through the cigarette paper towards the burning ember, controls the rate of air diffusion and hence, the free burn rate of the coal 166. By reducing the free-burn rate in a controlled manner, sidestream smoke emitted from the idle cigarette is substantially reduced or virtually eliminated. During this process of controlling free-burn rate, the shape of the coal inverts from its normal convex shape to the shown concave shape. However, upon the next puff the coal resumes its normal convex shape and slowly inverts again as free-burn rate is reduced.

If the cigarette were to remain idle with the device 148 in the position shown, the burning ember 166 slowly advances into the device 148. However, as that advance continues, eventually a point is reached where insufficient oxygen reaches the burning coal 166 and the cigarette extinguishes. If the cigarette were left unattended, the device 148 ensures that extinguishment occurs thereby providing a significant safety factor in preventing fires caused by unattended cigarettes.

The inner ring 168 in controlling the rate at which oxygen diffuses therethrough, is designed to permit sufficient air to reach the coal 166 such that it continues burning at a reduced rate and does not extinguish for normally in excess of one minute and preferably two to three minutes. During that interval, sidestream smoke is virtually eliminated. However, the smoker may take up the cigarette and by retracting the device 148 along the cigarette expose at least a portion of the coal 166 to allow the smoker to puff the cigarette and again advance the coal along the cigarette. It has been found that one can also advance the ring back over the burning coal to immediately reduce sidestream smoke particularly if the ash has not moved up to the ring during the smoker puffing on the cigarette.

When it is time for the next puff, the device 148 may be readily sled along the cigarette by the smoker grasping the device with his or her fingers and moving it along the cigarette a desired extent which is usually just enough to expose the burning coal 166. One of the features, however, of the smoker's kit is to provide a recess 114 which may be used to retract the device along the cigarette as the lit end of the cigarette is placed into the recess. This feature is particularly beneficial should the ring become too hot to touch. For example, if the ring is of metal, the heat of the burning coal may render the ring too hot so that the ring retraction may be accomplished by use of the recess 114.

As shown in FIG. 20, the lit cigarette 142 with the device 148 in position is lowered in the direction 172 into the recess 114 of the smoker's kit. In accordance with this embodiment, the recess 114 has a plurality of overlapping wires 174 secured to an outer ring 176. The wires 174 overlap one another and extend downwardly, as shown in FIG. 21. The wires 174 provide inwardly converging ledges, as defined by the inner surfaces 178 thereof. The overlapping region for the wires defines a bottom 180 for the recess where they converge to a fairly restricted surface area, normally less than the cross-sectional area of the cigarette 142. By virtue of the converging surfaces 178, the outer ring 170 abuts the wires in the region 182 as the cigarette continues to be advanced into the recess in the direction of arrow 172. It slides through the device 148 until the lit end 166 abuts the bottom portion of the converging wires, normally in region 184. Converging wires 178 define a first stop at region 182 for the device 148 by contacting the outer ring 170 in a region alongside the cigarette. As the cigarette continues to advance into the recess, a second stop is defined by the converging wires to engage the burning ember and define the extent to which the device 148 is retracted along the cigarette. Such extent of retraction is defined by the opposing arrows 186. Such extent of retraction is sufficient to permit a smoker to puff on the cigarette and obtain the desired degree of inhaled smoke before the burning ember again advances either near to or within the ring 148.

It is understood that various structures are contemplated for retracting the ring along the cigarette. For example, the solid outer ring 176 may have a plurality of inwardly downwardly sloping fingers integral therewith. The fingers may be truncated to define at their tips, an aperture through which the burning ember may extend thereby acting as the stop to the side of the cigarette to retract the ring as the cigarette is advanced through the aperture.

When the smoker has smoked the cigarette to the desired extent, it may be inserted in the snuffer 116. As shown in FIG. 16, the snuffer is simply a cylindrical bore having an interior surface 188. The bore normally has a closed bottom although it may be open to allow ashes to fall out of the bore 116 and into the bottom of the kit 100. As long as the inner surface 188 of the bore snugly fits the cigarette, the flow of air to the burning ember is essentially cut off to extinguish the cigarette rapidly, usually within less than 15 seconds. Rather than attempting to remove the ring 148 from the lit cigarette before inserting the cigarette in the snuffer 116, it is preferable to simply align the lit cigarette end with the snuffer 116 and push it into the bore where the perimeter 190 of the bore engages ring 148 and prevents its further movement. This allows the cigarette to advance further into the bore of the snuffer as the ring 148 is further retracted along the cigarette. A smoker may then either subsequently remove the ring 148 from the cigarette after the ring has cooled down and place it in the holder 112 or if there is sufficient cigarette left, light the previously snuffed out cigarette end and then move the ring 148 towards the lit end of the cigarette to again, commence control of sidestream smoke emitted from the cigarette when it is idle.

In addition to those procedures and the use of the kit, it is understood that the exhale filter 136 provided with the smoker's kit may also be used to capture smoke exhaled by the smoker. The exhale filter 136 may be similar to that described in applicant's co-pending U.S. application Ser. No. 08/226,890. In confined places such as the home, office, plane, car and other vehicles, this system is very useful in decreasing the amount of smoke released during the smoking process. It is also understood that the smoker's kit 100 may include a device for mounting the system on an ashtray, particularly on a vehicle ashtray to permit use of the device while operating or riding in a vehicle. The recess 114 is design to have a very gradual slope to the wires to allow one to retract the device along the cigarette without having to pay close attention to the placement of the cigarette in the recess 114.

Figure 22:
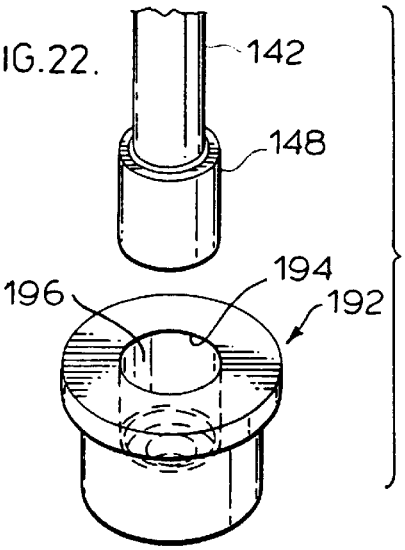
FIG. 22 is a perspective of an alternative type of recess into which the lit cigarette with the device may be inserted.
Figure 23:
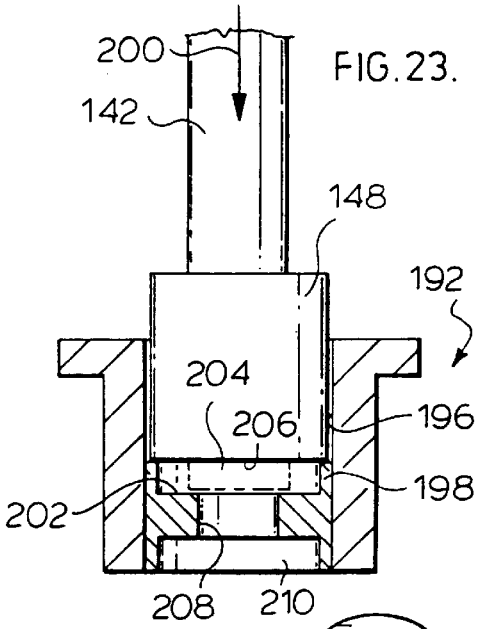
FIG. 23 is a section through the device of FIG. 22, showing the manner in which the device is retracted along the cigarette.

An alternative embodiment for advancing the device along the cigarette is shown in FIGS. 22 and 23. The lit cigarette 142 has the device 148 mounted thereon. An alternative recess 192 is provided. The device 192 has an opening 194 which is of a diameter greater than the external diameter of the ring 148. The opening defines downwardly extending recess 196 to receive the ring 148. As shown in FIG. 23, the recess 196 has at the base thereof, a stop 198. The stop to the side of the cigarette engages the ring 148 to stop its advance into the recess 196 as the cigarette 142 is advanced in the direction of arrow 200. The cigarette then continues to advance through the ring 148 until it abuts the bottom 202 of the recess 196. Again, this system determines the extent that the lit end of the cigarette extends beyond the outer edge 206 of the ring 148. The base of the recess may have an opening 208 to allow ashes to escape therefrom and be collected beneath the recess in the cavity 210.

Figure 24:
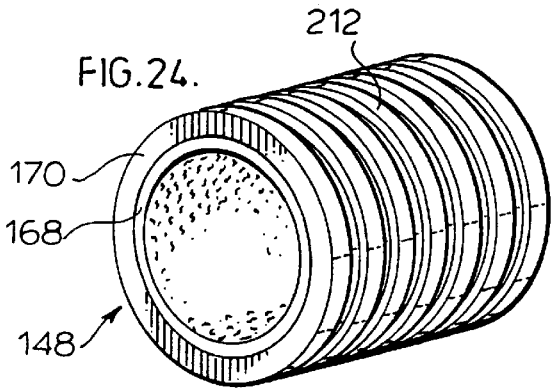
FIG. 24 is a perspective view of the device having a special exterior ring structure to provide point contact with the fingers.
Figure 25:
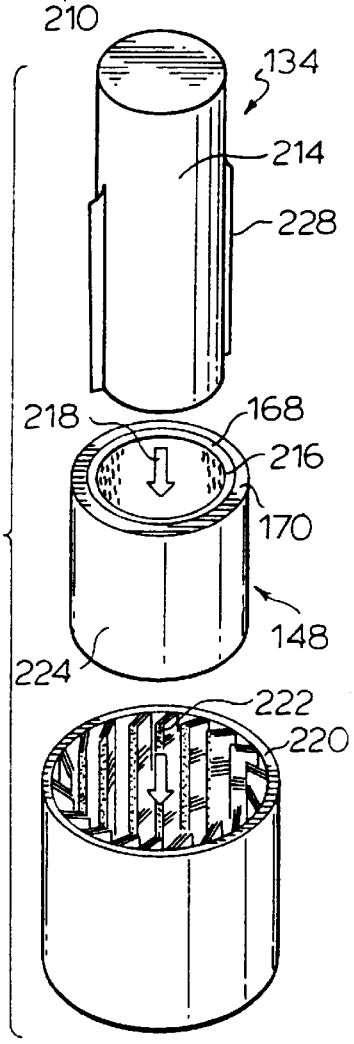
FIG. 25 is an exploded perspective view of a system for cleaning the exterior of the device.
Figure 26:
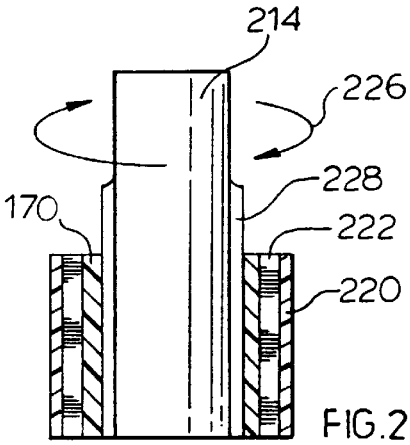
FIG. 26 is a section through the device of FIG. 25 showing the use of brushes to effect cleaning of the exterior of the device.

In keeping with the earlier described embodiments for the device 148, the external ring 170 may have a plurality of annular ribs 212 similar to those of FIG. 1A, which reduce heat conduction to the users fingers and facilitate hand movement of the device along the cigarette. It is understood that the outer ring 170, which is preferably impervious to air, may be made from ceramic, metal, plastic, paper and the like. The preferred outer ring is made of metal or ceramic and has the ribs 212, as shown in FIG. 24 formed therein in the process of making the outer ring 170. A design feature for the outer ring 170 is that the fibrous inner ring 168 is replaceable. As shown in FIG. 25, a cylindrical tool 214 may be used to knock the fibrous insert 168 out of the outer ring 170. The tool has a diameter greater than the internal diameter of the inner ring 168 so that it gauges the head portion 216 of the inner ring but the diameter of the tool 214 is less than the interior diameter of the outer ring 170. By pushing on the tool 214 and grasping the ring 170, the fibrous insert 168 can be knocked out in the direction of arrow 218. The holder 112 for the device 148 has an outer ring portion 220. A plurality of inwardly projecting bristles 222 are provided inside ring 220. The bristles extend inwardly sufficiently to engage the outer surface 222 of the ring 170. As shown in FIG. 26, the tool 214 is rotated in the direction of arrows 226. The tool 214 may have outwardly projecting ribs 228 for engaging the interior of the ring 170. By virtue of such frictional engagement, the ring 170 is rotated against the bristles 222 to clean thereby the exterior surface 224 of the ring of any stains and the like which may accumulate on the exterior of the ring.

It is appreciated that a single cigarette may be used to store a plurality of the ring devices. Such storage of the devices may be helpful when several of the devices are required for purposes of smoking a package of cigarettes. Alternatively, a ring device may be mounted on each cigarette of a package of cigarettes and simply disposed when each cigarette is finished.

One the features of the free-burn rate control device of this invention, having the porous material as the inner ring is to improve sidestream smoke reduction, minimize staining due to condensation in the vicinity of the device and provide acceptable taste. Experiments have been conducted to demonstrate the advantages of the preferred embodiment where the porous inner ring is the preferred carbon fibre material. The outer ring is of the preferred air impervious brass metal. The selected design for the ring is that of FIG. 1D for a solid brass ring having no gap between the inner surface 44 and the cigarette perimeter and the embodiment of FIG. 1B which allows a direct comparison between a brass ring having a gap between the inner surface of the outer ring 34 and the cigarette perimeter and with the fibrous insert in place which engages the cigarette perimeter. When the fibrous inner ring is not in place the feet 28 support the ring on the cigarette so that a gap is defined between the inner surface of the outer ring and the cigarette perimeter. The devices tested were a solid brass ring with no gap, a brass ring with a 1 mm gap between the interior of the ring and the cigarette surface. The inside diameter of the ring is equal to the diameter of the cigarette plus 2 mm. The next device was a brass ring with a 2 mm. gap, that is where the interior diameter of the ring is equal to the diameter of the cigarette plus 4 mm. The two preferred devices were the use of the 1 mm. gap brass ring and the 2 mm. gap brass ring for the outer ring where the inner ring is of porous carbon fibre matt material. In the first aspect, the fibrous material is 1 mm. thick and in the second aspect the fibrous material is 2 mm. thick. The devices were each tested at various lengths of the inside surface which is ahead of the feet 28 for the rings which have a gap. While recording several characteristics of the smoked cigarette and operation of the device, the observed characteristics included the devices' ability to extinguish the cigarette and time to self-extinguishment, sidestream smoke reduction, off-taste and staining of the cigarette. The following Table 1 summarized the test results.

TABLE 1

TEST: DEVICE FOR CONTROLLING FREE-BURN RATE OF A LIT CIGARETTE

| INNER RING | | | | | | | | | | |
|---|---|---|---|---|---|---|---|---|---|---|
| OUTER RING | | | | | | BRASS SOLID | | | | |
| LENGTH OF DEVICE | | 1 mm. | | 3 mm. | | 6 mm. | | 7 mm. | | 9 mm. |
| SMOKED THROUGH TIME | | N.A. | | 30" | | | | | | |
| SIDESTREAM REDUCTION | | NONE | | SLT. | | SOME | | SOME | | SOME |
| SELF EXTINGUISH TIME | | | | | | 2'50" | | 2'30" | | 2'12" |
| OFF TASTE | | NONE | | NONE | | NONE | | NONE | | BAD* |
| CONDENSATION (C = PRESENT) | | C | | C | | C | | C | | C |
| INNER RING | | | 1 mm. GAP | | | | | 2 mm. GAP | | |
| OUTER RING | | | BRASS | | | | | BRASS | | |
| LENGTH OF DEVICE | 3 mm. | 5 mm. | 7 mm. | 9 mm. | 12 mm. | 3 mm. | 5 mm. | 7 mm. | 9 mm. | 12 mm. |
| SMOKED THROUGH TIME | | | | | | | | | | |
| SIDESTREAM REDUCTION | EXC. | EXC. | EXC. | EXC. | EXC. | SLT. | SLT. | SLT. | SLT. | SOME |
| SELF EXTINGUISH TIME | 55 | 3'4" | 3'38" | 2'51" | 2'58" | 3'7" | 4'13" | 5'27" | 4'15" | 4'17" |
| OFF TASTE | NONE | NONE | NONE | BAD* | BAD* | BAD** | BAD** | NONE | NONE | NONE |
| CONDENSATION (C = PRESENT) | C | C | C | C | C | C | C | C | C | NONE |
| INNER RING | 1 mm. GAP - 1 mm POROUS MAT. - WITH FEET | | | | | 2 mm. GAP - 2 mm. POROUS MAT. - WITH FEET | | | | |
| OUTER RING | | | BRASS | | | | | BRASS | | |
| LENGTH OF DEVICE | 3 mm. | 5 mm. | 7 mm. | 9 mm. | 12 mm. | 3 mm. | 5 mm. | 7 mm. | 9 mm. | 12 mm. |
| SMOKED THROUGH TIME | | | | | | | | | | |
| SIDESTREAM REDUCTION | EXC. | EXC. | EXC. | EXC. | EXC. | EXC. | EXC. | EXC. | EXC. | EXC. |
| SELF EXTINGUISH TIME | 2'28" | 3'1" | 3'21" | 2'26" | 2'50" | 3'14" | 3'33" | 4'29" | 3'28" | 3'59" |
| OFF TASTE | NONE | NONE | NONE | NONE | NONE | NONE | NONE | NONE | NONE | NONE |
| CONDENSATION (C = PRESENT) | NONE | NONE | NONE | NONE | NONE | NONE | NONE | NONE | NONE | NONE |

REDUCTION OF SIDESTREAM LEGEND SCALE
NONE SLIGHT (SLT.) SOME EXCELLENT (EXC.)
COMMENTS:
BAD* OFF TASTE DUE TO HEAVY CONDENSATION ON CIGARETTE
BAD** = SLIGHT TARRY TASTE

The solid brass ring with no clearance between the inside of the ring and the cigarette perimeter has several problems. At the longer lengths of the ring there is a bad off-taste for each length of the ring that provided some sidestream smoke control. There was significant condensation on the cigarette, although the extinction times were acceptable-in excess of 2 minutes. A further problem with the solid brass ring is that at a 3 mm length it managed to burn right through the ring as indicated by the "smoked through time".

The results for the brass ring for the 1 mm. gap indicates a significant improvement over the solid brass ring which is in contact with the cigarette perimeter. The brass ring with the gap has excellent sidestream smoke control and better extinguishment times. However, condensation continues to be a problem and off-taste is also a problem with the longer lengths of the inner surface of the ring which defines the gap. The 2 mm. gap ring provides a significant improvement with respect to taste and for the exceptionally long inner ring surface of 12 mm. in length, condensation was not a problem. However, sidestream smoke reduction has been lost to the extent that there is only a slight or some reduction in sidestream smoke. With all three brass ring devices, staining in the form of condensation is a serious problem with the exception for the very long lengths of brass rings with the 2 mm. gap.

When an inner ring of the porous material is used and has a radial thickness of either 1 mm. or 2 mm. and the varying lengths of 3 mm. through to 12 mm., there is a very striking improvement in sidestream smoke reduction, improved taste and lack of condensation. In looking at the test results for the 1 mm. gap and 2 mm. gap brass ring, one would be inclined to move towards the brass ring with the 2 mm. gap because of the improved taste and at the longer lengths, no condensation. However, sidestream smoke reduction degenerates quickly.

In direct comparison, the brass ring with 2 mm. thickness of porous material has excellent sidestream smoke reduction at all lengths of the ring, no off-taste for all lengths of the ring and no condensation which will cause unsightly staining of the cigarette for all lengths of the ring. A further comparison is the inner ring of fibrous material having a thickness of 1 mm. out performs both brass rings with the 1 and 2 mm. gaps, particularly in respect of no off-taste, no condensation and with respect to the 2 mm. ring, there is a significantly improved sidestream smoke reduction.

These test results clearly demonstrate the advantages of the preferred embodiment of the free-burn rate control device using an inner ring of fibrous material. Sidestream smoke is reduced, extinction times are more than acceptable for all lengths of the rings, and no off taste and no unsightly staining.

In accordance with this invention, a device is now provided in the form of several of the described preferred embodiments to achieve control of free burn rate of the cigarette while maintaining normal taste and puff sensation comparable to the cigarette when smoked without the device. The device, in accordance with this invention, also has the ability to reduce sidestream smoke and preferably in the event that the cigarette is left unattended, extinguish the cigarette to thereby provide an additional safety factor.

Although various preferred embodiments of the invention have been described with respect to the drawings, it is understood that many variations may be made thereto without departing from the spirit of the invention as scope of the appended claims.

We claim:

1. A device for controlling free burn rate of a lit cigarette and the like, said device comprising:

i) an inner ring having an interior dimension to surround and contact cigarette perimeter, said inner ring defining an annulus of porous material which provides tortuous paths of air flow along a length dimension of said inner ring;

ii) said interior dimension permitting said inner ring to be slid along a cigarette as a cigarette is smoked, iii) an outer ring encasing said inner ring to direct air flow along said length dimension of said inner ring;

iv) said tortuous paths of said annulus controlling rate of air diffusion to reduce supply of oxygen for supporting tobacco combustion by a lit cigarette coal and controlling thereby free burn rate of a lit cigarette.

2. A device of claim 1 wherein said annulus in reducing supply of oxygen to control free burn rate of a lit cigarette, reduces sidestream smoke emitted by a lit cigarette.

3. A device of claim 2 wherein said inner ring is of fibrous material dimensioned to surround and contact a perimeter portion of a cigarette; said fibrous material being porous and stable at combustible temperatures of a lit cigarette coal.

4. A device of claim 3 wherein said fibrous material is in the form of a matt.

5. A device of claim 3 wherein said fibrous material includes activated charcoal.

6. A device of claim 3 wherein said fibrous inner ring slidably engages said outer ring interior to permit replacement of said fibrous ring, said outer ring being impervious to air.

7. A device of claim 6 wherein said outer ring is of metal.

8. A device of claim 3 wherein said outer ring is of ceramic, non-porous paper, glass, plastic or metal.

9. A device of claim 3 wherein said outer ring includes means for engaging a cigarette rearwardly of where said fibrous ring engages a cigarette portion.

10. A device of claim 9 wherein said means for engaging a cigarette includes means for indexing movement of said inner ring along a cigarette.

11. A device of claim 1 wherein said annulus of tortuous paths being of a porous fibrous material, a porous sintered material or a porous matted material.

12. A device of claim 11 wherein said sintered material is selected from the group consisting of sintered metal oxides, sintered glass and sintered high temperature plastic.

13. A device of claim 12 wherein said sintered material is sintered glass.

14. A device of claim 1 wherein said outer ring is impervious to air.

15. A device of claim 1 wherein said outer ring extends beyond said inner ring.

16. A cigarette in combination with a device of claim 1.

17. A cigarette having a plurality of said devices of claim 1 mounted thereon to provide storage for said devices.

18. A package of cigarettes where each cigarette has a device of claim 1 mounted thereon.

19. A package of cigarettes wherein at least one cigarette has a plurality of said devices of claim 1 mounted thereon for storage of said devices in said package.

20. A smoker's kit for use in reducing sidestream smoke released from a burning cigarette and the like by controlling the burn rate thereof, said kit comprising:

i) a device for reducing sidestream smoke, said device comprising a ring dimensioned to surround and contact a portion of said cigarette, said device being retractable along a cigarette as a cigarette is smoked;

ii) a holder for said device, said holder presenting said device to permit insertion of an end of a cigarette into said ring; and iii) means for retracting said device along a lit cigarette when an end of a lit cigarette is engaged with said retracting means.

21. A smoker's kit of claim 20 wherein said retracting means comprises a stop for contacting said device, said stop being located alongside a cigarette end portion when a lit cigarette is engaged with said retracting means.

22. A smoker's kit of claim 20 further comprising a snuffer to snuff out a lit cigarette when a lit cigarette end is inserted in said snuffer, said snuffer comprising a stop for retracting said device along a cigarette when a lit cigarette end is inserted in said snuffer.

23. A smoker's kit of claim 20 wherein said retracting means comprises an ash receptacle beneath said stop, said ash receptacle including a deodorizer.

24. A smoker's kit of claim 20 wherein said device, said holder and said retracting means are all provided in a carrier, said carrier having a removable lid to expose said device, holder and retracting means for use.

25. A smoker's kit of claim 24 wherein said carrier has an open-bottom ash receptacle beneath said retracting means and a removable bottom to permit dumping of ashes from said receptacle.

26. A smoker's kit of claim 25 wherein said retracting means comprises a body portion which defines a recess for receiving a lit cigarette end and includes a stop for engaging said device as a lit cigarette end is inserted in said recess to retract said device along a lit cigarette.

27. A smoker's kit of claim 26 wherein said body portion comprises a converging portion for engaging said device and stopping advance of said device into said body portion as a lit cigarette is inserted in said recess.

28. A smoker's kit of claim 27 wherein said converging portion comprises a plurality of inwardly extending fingers.

29. A smoker's kit of claim 28 wherein said converging portion is circular.

30. A smoker's kit of claim 28 wherein said plurality of inwardly extending fingers are formed from wire which overlap to define a bottom portion for said recess.

31. A smoker's kit of claim 30 wherein said bottom portion of said recess is located to define an extent to which a lit cigarette is inserted into said recess and thereby determines a corresponding extent to which said device is retracted along a lit cigarette.

32. A smoker's kit of claim 25 wherein said removable bottom includes a deodorizer.

33. A smoker's kit of claim 32 wherein said deodorizer comprises a replaceable pad of activated carbon material.

34. A smoker's kit of claim 20 wherein said device holder comprises means for cleaning a peripheral portion of said device.

35. A smoker's kit of claim 20 wherein said device comprises:

i) an inner ring having an interior dimension to surround and contact cigarette perimeter, said inner ring defining an annulus of porous material which provides tortuous paths of air flow along a length dimension of said inner ring;

ii) said interior dimensional permitting said inner ring to be slid along a cigarette as a cigarette is smoked, iii) an outer ring encasing said inner ring to direct air flow along said length dimension of said inner ring;

iv) said tortuous paths of said annulus controlling rate of air diffusion to reduce supply of oxygen for supporting tobacco combustion by a lit cigarette coal and controlling thereby free burn rate of a lit cigarette.

36. A smoker's kit of claim 35 wherein said annulus in reducing supply of oxygen to control free burn rate of a lit cigarette, reduces sidestream smoke emitted by a lit cigarette.

37. A smoker's kit of claim 36 wherein said inner ring is of fibrous material dimensioned to surround and contact a portion of a cigarette; said fibrous material being porous and stable at combustible temperatures of a lit cigarette coal.

38. A smoker's kit of claim 37 wherein said fibrous material is in the form of a matt.

39. A smoker's kit of claim 37 wherein said fibrous material includes activated charcoal.

40. A smoker's kit of claim 37 wherein said fibrous inner ring slidably engages said outer ring interior to permit replacement of said fibrous ring, said outer ring being impervious to air flow.

41. A smoker's kit of claim 40 wherein said outer ring is of metal.

42. A smoker's kit of claim 37 wherein said outer ring is of ceramic, non-porous paper, glass, plastic or metal.

43. A smoker's kit of claim 37 wherein said outer ring includes means for engaging a cigarette rearwardly of where said inner fibrous ring engages a cigarette portion.

44. A smoker's kit of claim 43 wherein said means for engaging a cigarette includes means for indexing movement of said ring along a cigarette.

45. A smoker's kit of claim 35 wherein said annulus of tortuous paths being of a porous fibrous material, a porous sintered material or a porous matted material.

46. A method of reducing sidestream smoke of a lit cigarette and the like comprises:

i) locating a device of claim 1 on said cigarette near its burning coal;

ii) retracting said device along said cigarette away from said cigarette coal before a user puffs on said cigarette, said device being retracted a desired extent to allow said burning coal to advance near or within said device as a user puffs on said cigarette.

47. A method of claim 46 wherein said device is retracted along said cigarette by engaging said device with a stop and pushing said cigarette through said device said desired extent.

48. A method of claim 47 wherein said stop is provided in a recessed body portion which includes a bottom, said method further comprising pushing said cigarette through said device until said lit end contacts said bottom of said recess to determine said extent of retraction of said device along said cigarette.

49. A method of claim 47 wherein said outer ring of device is rigid, said step of retracting said device comprises engaging said stop with said rigid outer ring.

50. A method of claim 47 wherein inner ring is of said fibrous material of said device is in the form of a matt.

51. A method of claim 50 wherein said fibrous material includes activated charcoal.

52. A method of claim 46 wherein said desired extent of device retraction allows said burning coal to advance within said device.

53. A method of claim 46 further comprising advancing said device over said cigarette coal immediately after a user puffs on said cigarette.

* * * * *